US008777698B2

(12) United States Patent
O'Shannessy

(10) Patent No.: US 8,777,698 B2
(45) Date of Patent: Jul. 15, 2014

(54) HAND TOOL SUPPORT AND DUST SHROUD

(75) Inventor: Peter O'Shannessy, Camberwell (AU)

(73) Assignee: Advanced Posture Systems Pty. Ltd., Camberwell, Victoria (AU)

( * ) Notice: Subject to any disclaimer, the term of this patent is extended or adjusted under 35 U.S.C. 154(b) by 842 days.

(21) Appl. No.: 12/820,626

(22) Filed: Jun. 22, 2010

(65) Prior Publication Data

US 2010/0261417 A1 Oct. 14, 2010

(51) Int. Cl.
*B25B 23/00* (2006.01)

(52) U.S. Cl.
USPC ..... 451/344; 451/451; 451/455; 451/456; 451/457

(58) Field of Classification Search
USPC ..... 451/344, 451, 455, 456, 457
See application file for complete search history.

(56) References Cited

U.S. PATENT DOCUMENTS

| | | | | |
|---|---|---|---|---|
| 3,882,644 | A * | 5/1975 | Cusumano | 451/359 |
| 6,471,574 | B1 * | 10/2002 | Rupprecht et al. | 451/451 |
| 8,282,447 | B1 * | 10/2012 | Buser | 451/451 |
| 2002/0115396 | A1 * | 8/2002 | Sarantitis | 451/350 |

* cited by examiner

*Primary Examiner* — Lee D Wilson
*Assistant Examiner* — Shantese McDonald
(74) *Attorney, Agent, or Firm* — Michael J. Keller; Keller Life Science Law, P.A.

(57) ABSTRACT

An abrading tool has a grinding disc mounted to the shaft of a motor, and a dust shroud which has a depending flange which extends over and about a periphery of the grinding disc, the dust shroud having a flattened segment, and a peripheral flexible and adjustable skirt which attaches to and extends beyond the depending flange.

43 Claims, 19 Drawing Sheets

HAND TOOL SUPPORT AND DUST SHROUD

RELATED APPLICATIONS

This application claims priority to PCT/AU03/001730, filed on Dec. 23, 2003 and to U.S. application Ser. No. 11/166,504, filed on Jun. 23, 2005

FIELD OF THE INVENTION

This invention relates to a hand tool support and relates particularly, though not exclusively, to a hand tool support for angle grinders.

BACKGROUND OF THE INVENTION

Angle grinders are well known hand tools and are used with many attachments. One purpose is to prepare a smooth surface by rotational abrasion. All presently available floor grinders are designed to be used with the operator either standing upright, or crouching or kneeling. The upright operation limits the direction of movement of the grinder head to either forward and backward, or from side to side. The grinding head also cannot be easily floated in a circular motion from a standing position with good control. Upright grinders cannot be floated in a circular motion because it requires holding the grinding disc or head parallel to the floor without tipping it to one side while moving it in a circular motion. Due to the poor balance from the long handle and the leverage requirements to move in a circular motion this is almost impossible under normal operating conditions from a standing position. In the kneeling position however, the grinder can be floated with good control. It can be moved in a circular direction to give a smooth finish to the work, but this is physically damaging to the back and/or the knees due to the bent bodily position. In addition many available dust shrouds or hoods stick readily to the floor when vacuum is applied because they are made of flexible materials or do not have adjustable seals. This can prevent floating, or at best can make operation of the tool very difficult. It is important to achieve and maintain an efficient and low friction seal about the grinding disc and the dust shroud that allows sufficient air flow for efficient vacuuming of grinding dust, and is configured for grinding along a straight edge such as at a floor to wall intersection. Grinding tool dust shrouds of the prior art have not achieved this.

SUMMARY OF THE PRESENT INVENTION

It is an object of the present invention to provide a hand tool support which will alleviate the abovementioned problems.

A further object of the invention is to provide a hand tool support which can be adapted to be associated with modified conventional grinders or existing grinders, or integrated therewith.

With these objects in view the present invention may provide a hand tool support including a pair of handles angled with respect to one another, a frame element or connecting means adapted to be connected at one end thereof to at least one of said handles and at the other end to a hand tool, whereby, in use, said handles are located above said hand tool.

Preferably at least one of said handles includes a control means for activating said hand tool. In a practical embodiment said handles are substantially at right angles to one another. Preferably said handles are substantially co-planar. Preferably said hand tool is a grinder and one of said handles is aligned, in use, above the centre line of said grinder. It is also preferred that the junction of said handles overlies above the centre of the grinding disc of said grinder. In an especially preferred embodiment said grinder includes a dust shroud and, in use said frame element or connecting means is attached to said dust shroud.

In a further aspect of the invention there may be provided a hand tool with integrated hand tool support, said hand tool support including a pair of handles angled with respect to one another, a frame element or connecting means adapted to be connected at one end thereof to at least one of said handles and at the other end to said hand tool with said handles being located above said hand tool.

In another aspect of the invention there is provided a hand tool support including at least one handle means, a frame element or connecting means adapted to be connected at one end thereof to said at least one handle means and at the other end to a hand tool, whereby, in use, at least one handle means is located above said hand tool at a height to allow an operator to remain seated upright during use.

The invention also relates to a switch clamping device adapted to be placed on a handle of an electrically powered device which has a trigger switch for operation thereof, said switch clamping device including a housing which slides over a part of said handle and said trigger switch, said housing being deep enough to allow the electrical connector plug of said electrically powered device to be retained in said housing above said handle, and a trigger holding means coupled to said housing for holding said trigger switch closed.

Preferably said trigger holding means includes a rod passing through said housing to contact and hold said trigger switch closed. In a preferred embodiment said rod is adjustably mounted on said housing to allow for variations in handle and trigger switch depth. In a practical embodiment said housing is U-shaped and includes opposing wall members between the arms of said U-shaped housing to prevent escape of said electrical connector from said housing.

The invention also defines a dust shroud for an abrading tool, said dust shroud including a base plate and a peripheral skirt depending therefrom, an outlet pipe opening into said base plate for extraction of abraded material, and a flexible skirt attached to the outer periphery of said depending skirt depending beyond said peripheral skirt.

Preferably the dust shroud includes a clamping means to hold said flexible skirt to said depending skirt to allow for adjustment of the depth of said flexible skirt. In a practical embodiment said clamping means is a band clamp. The base plate may be circular and has a flattened segment which has a matching depending skirt part to expose said abrading tool for edging work. The dust shroud may include a separate arcuate segment having a base plate and co-operating depending skirt part, said arcuate segment co-operating with said flattened segment when edging work is not required. The co-operating depending skirt part may include a flexible skirt part. The flexible skirt has a cut out section or gap along a part of said flattened segment.

In an alternate preferred embodiment, a dust shroud for an abrading tool has a base plate with a depending flange, and an outlet pipe opening in the base plate for extraction of abraded material, a flattened segment in the depending flange, and a peripheral flexible skirt which depends from the depending flange, a grinding disc of the abrading tool extending through the peripheral flexible skirt.

In order that the invention may be more readily understood and put into practical effect, reference will now be made to the accompanying drawings.

DETAILED DESCRIPTION OF PREFERRED AND ALTERNATE EMBODIMENTS

Figure 1:
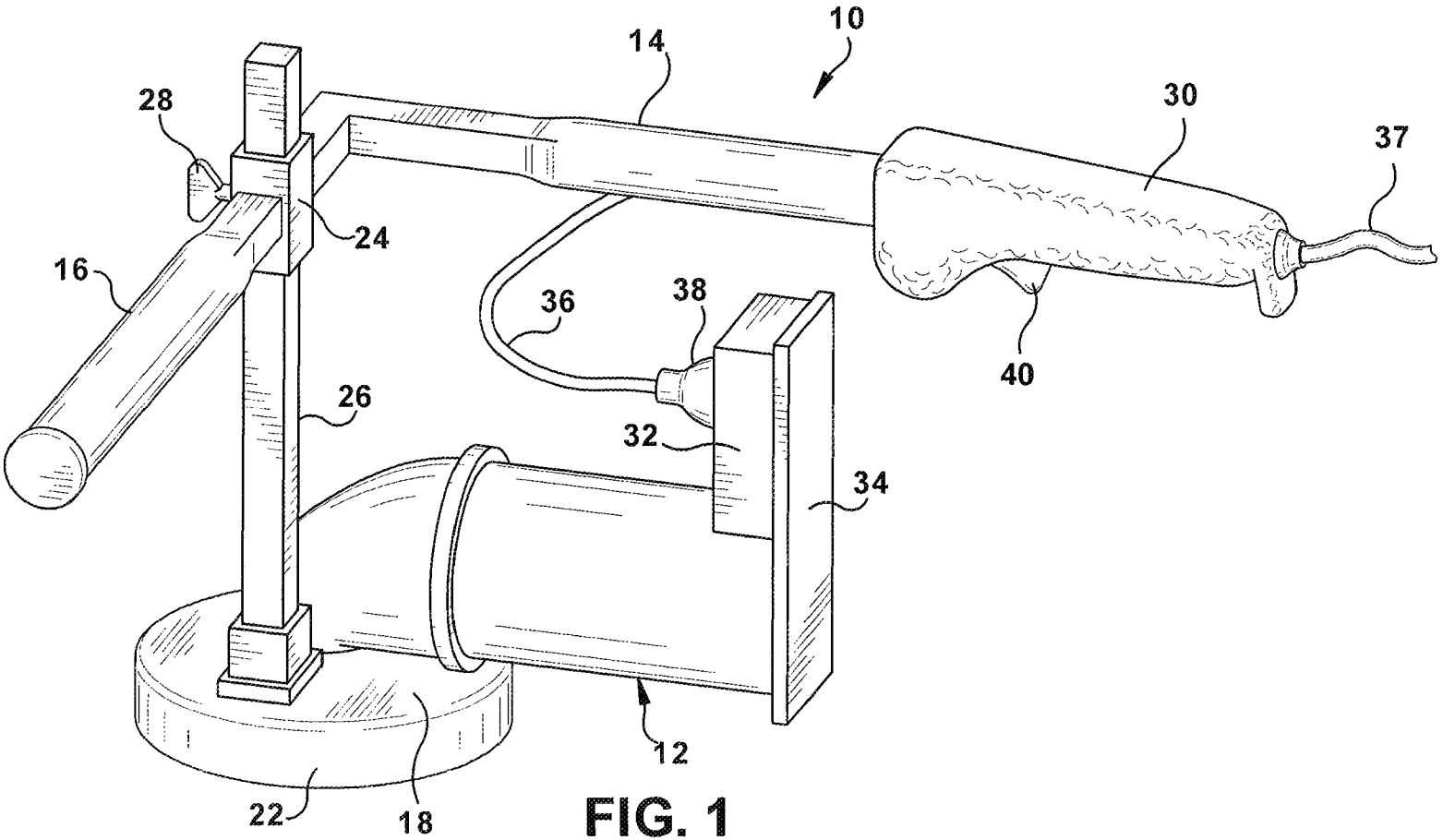
FIG. 1 is a perspective view of a first embodiment of a hand tool support made in accordance with the invention attached to a grinder.

In the various embodiments many of the components and construction are very similar. Accordingly, the same reference numerals will be used to avoid duplication of description.

In the embodiment shown in FIGS. 1 to 4 there is shown a hand tool support 10 coupled to an angle grinder 12. Hand tool support 10 has a pair of handles 14, 16 at right angles to one another. The handles 14, 16 are co-planar to provide a uniform height from the ground. Angle grinder 12 is fitted with a dust shroud 18 and outlet pipe 20 is coupled to a dust extractor (not shown) to remove abraded material from the surface being sanded or grinded. The outer periphery of the dust shroud 18 is fitted with a rubber skirt 22 that is held in position by a band clamp (not shown). Rubber skirt 22 is adjustable using the band clamp to allow for grinding discs (not shown) of varying height (wear) to form a seal. The fixed position of the rubber skirt 22 allows grinder 12 to float easily across the surface whilst maintaining excellent dust control.

Handle 14 is mounted parallel with the length of angle grinder 12 and handles 14, 16 intersect above the centre of the grinding disc (not shown) of angle grinder 12. This position will provide a good balance and ease of movement of the angle grinder across the surface. Handle 16 has a slide 24 for adjustable movement along tube 26 attached to dust shroud 18. The height adjustment position of handles 14, 16 can be locked by set screw 28 or other suitable clamping device.

Angle grinder 12 in this embodiment is a standard device which has been adapted for use with hand tool support 10. Angle grinder 12 has been split into two parts, namely with the motor (not shown) in one part and the trigger grip 30 in the other part. A suitable socket 32 is affixed to a backplate 34 with the backplate 34 covering the rear of the exposed casing of angle grinder 12 resulting from the split into two parts. The socket 32 includes internal wiring for electrical connection to the motor. A power lead 36 with a suitable plug 38 to fit socket 32 is fitted to power lead 36. Power lead 36 is coupled to trigger grip 30 through switch 40 for activation of the motor. Trigger grip 30 can be fitted to handle 14 in any suitable manner e.g. a slide tube, backplate, etc. Electrical power for angle grinder 12 comes from an electrical lead 37.

Figure 2:
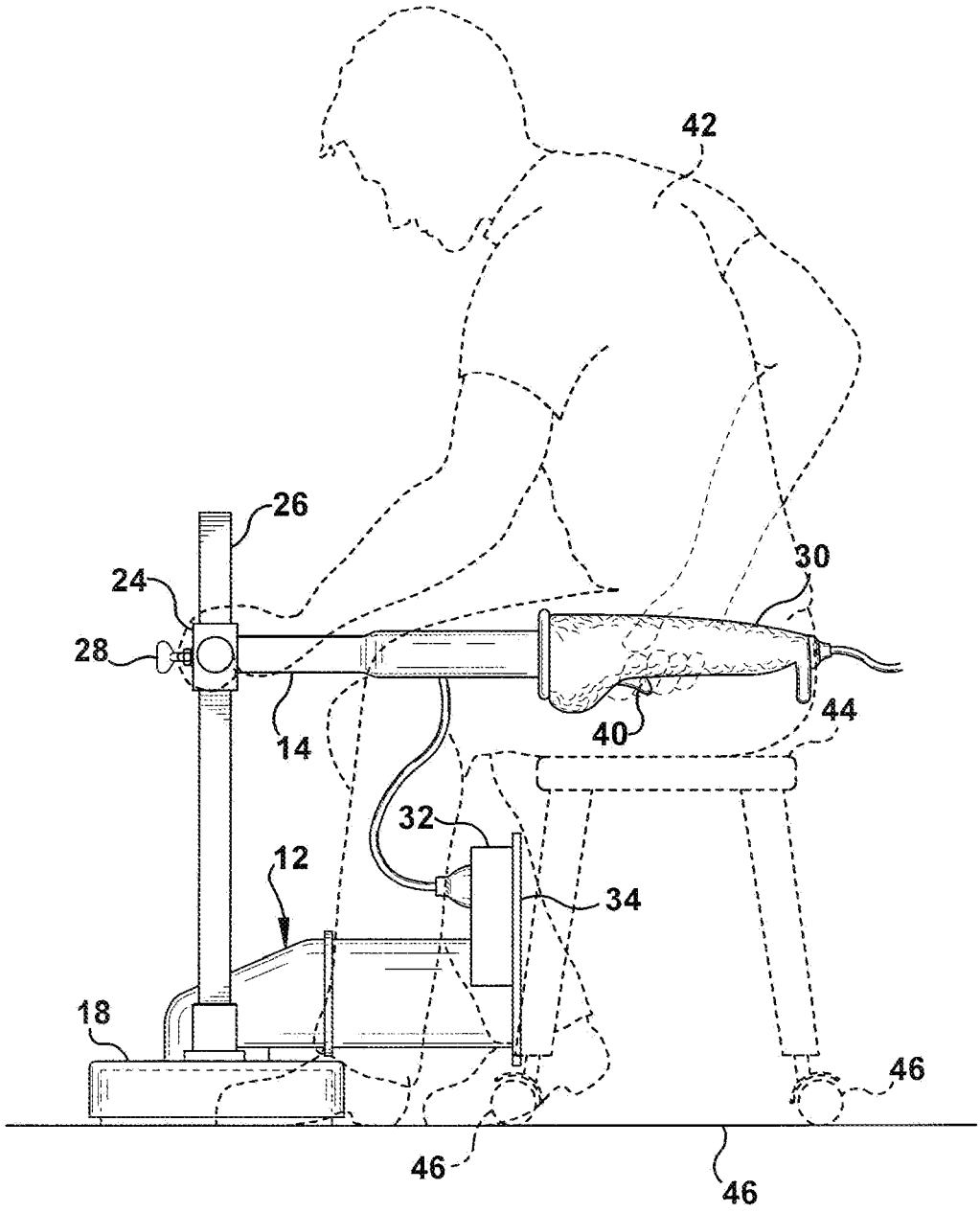
FIG. 2 is a side view of the hand tool support and grinder shown in FIG. 1 in use by an operator.
Figure 3:
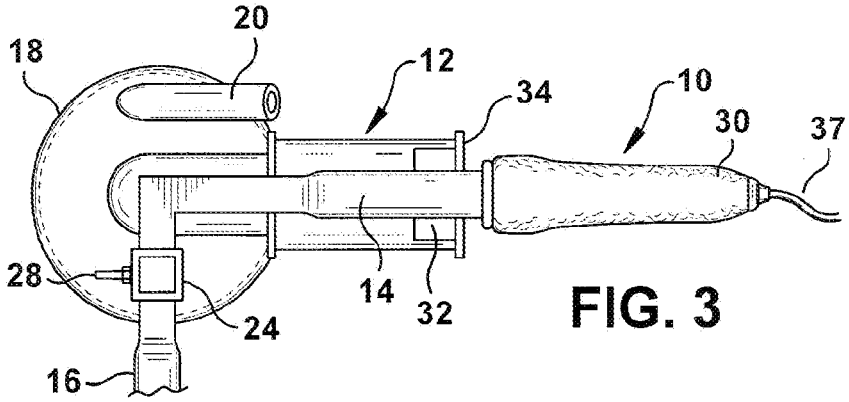
FIG. 3 is a plan view of the first embodiment shown in FIG. 1.
Figure 4:
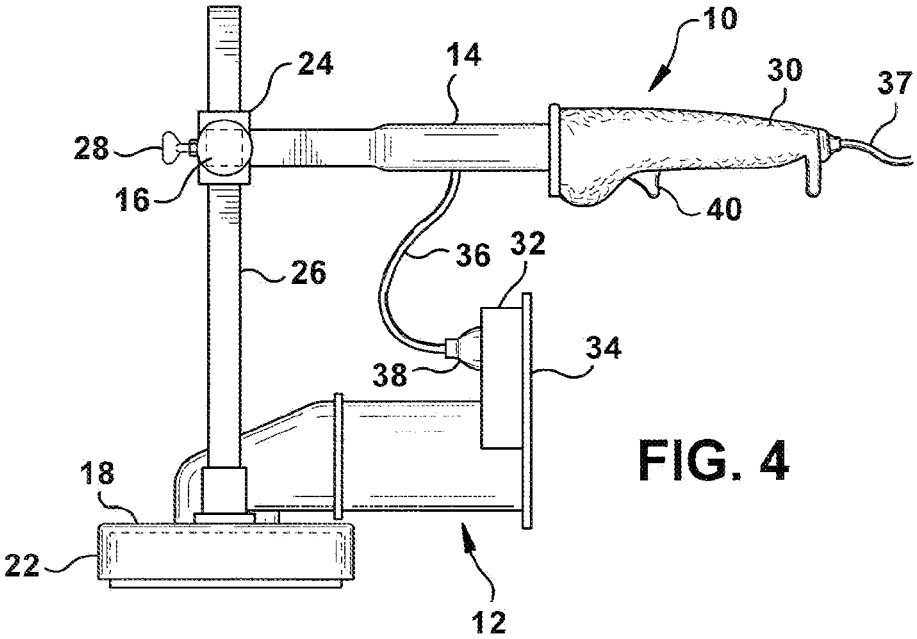
FIG. 4 is a side view of the first embodiment shown in FIG. 1.

FIG. 2 shows the use of hand tool support 10 with angle grinder 12. An operator 42 is seated on a stool 44. Stool 44 has castors 46 to allow the operator 42 to glide around surface 48 to be prepared eg sanded, scarified or grinded. Operator 42 will be comfortably seated in a substantially upright position with his feet on the ground rather than crouching or kneeling on his knees. The fixed position of the seal formed by rubber skirt 22 allows grinder 12 to float easily over surface 48 with a reduced risk of back or knee injury. The approximate 90 degree angle between handles 14, 16 enables grinder 12 to be controlled in every direction. Handle 14 allows for a forward and backward motion and backward weight distribution whilst handle 16 controls sideways movement and sideways weight distribution. Weight distribution shifts allow the outer cutting edge of the grinder disc to bite in harder than the flat surface of the disc normally does. The angled handles 14,16 allow the operator 42 to tilt grinder 12 forward or backwards, and also tilt it sideways both right and left. This provides control in every direction through the handles 14, 16. If the grinder disc bites too hard into surface 48 causing the grinding disc to tilt, altering the pressure on each handle 14, 16 will return the disc to the parallel direction very quickly. The positioning of switch 40 allows an improved operator control for grinder 12. As the operator's head is located higher than it would be if on his knees, the operator will have a reduced tendency to inhale abraded dust. As the operator does not need to shift position on his knees there will be a substantially reduced risk of knee injury or soreness and a substantial increase in productivity. Castors 46 on stool 44 will also assist in reduction of soreness and injury to knees and back and increased productivity. As the handles 14, 16 are spread wider apart than the handles provided on a traditional angle grinder a better leverage is obtained which reduces the effort to move the grinder across the surface while maintaining a flat position of the disc on the surface to enable it to float.

Figure 5:
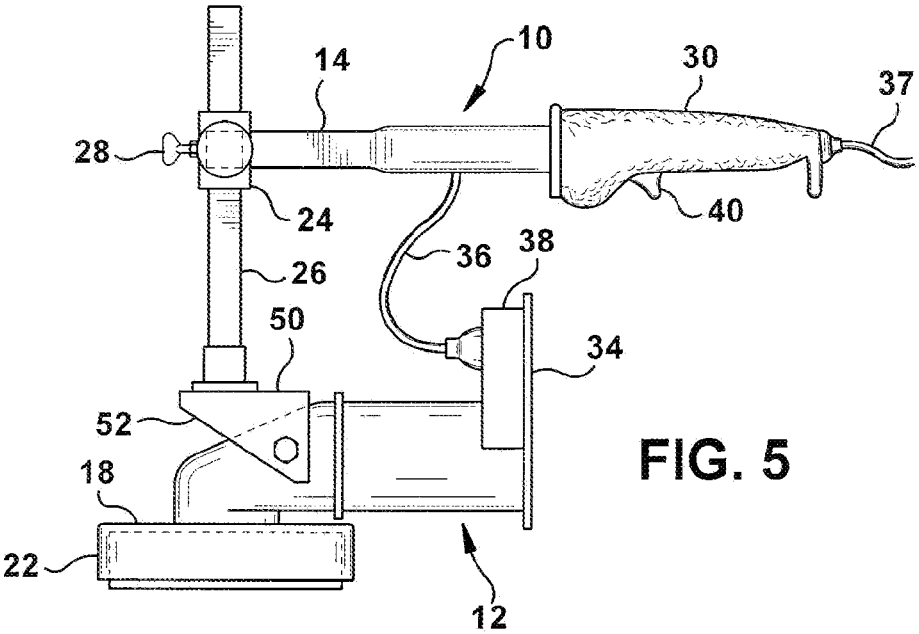
FIG. 5 is a side view of a second embodiment of a hand tool support and grinder.

FIG. 5 shows a second embodiment of a hand tool support 10 where vertical tube 26 is connected to a bracket 50 rather than dust shroud 18. Bracket 50 is typically U-shaped with side members 52 being bolted to either side of grinder 12. Handle 14 can then be directly connected to slide 24 rather than be offset from slide 24 as in FIGS. 1 to 4. This embodiment will provide a better balance for the operator than previous embodiment.

Figure 6:
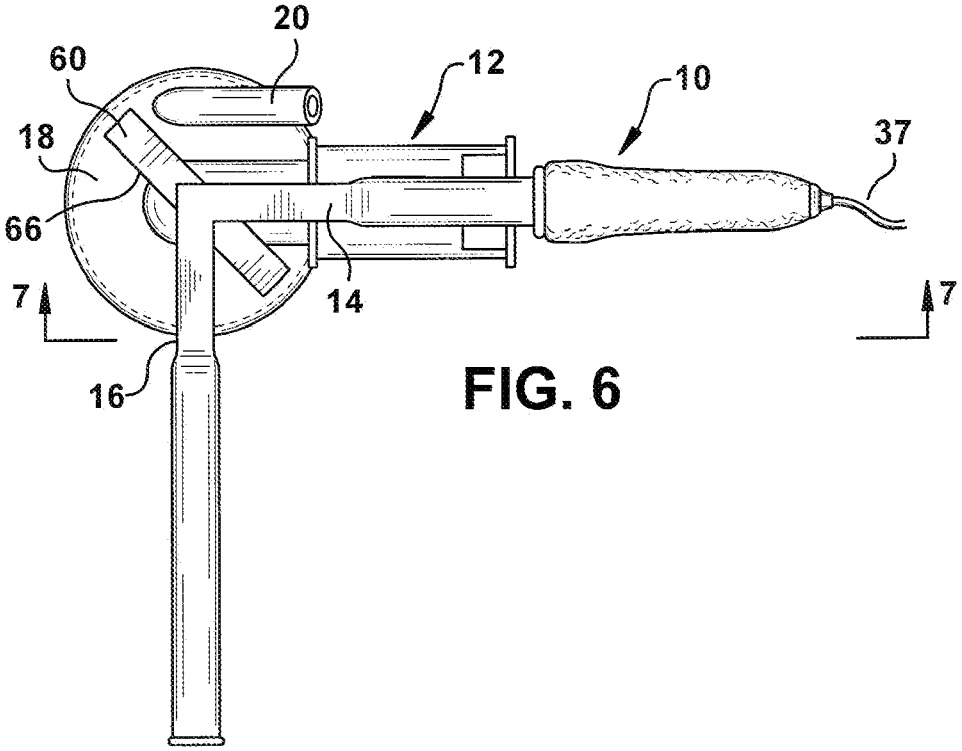
FIG. 6 is a plan view of a third embodiment of a hand tool support and grinder.
Figure 7:
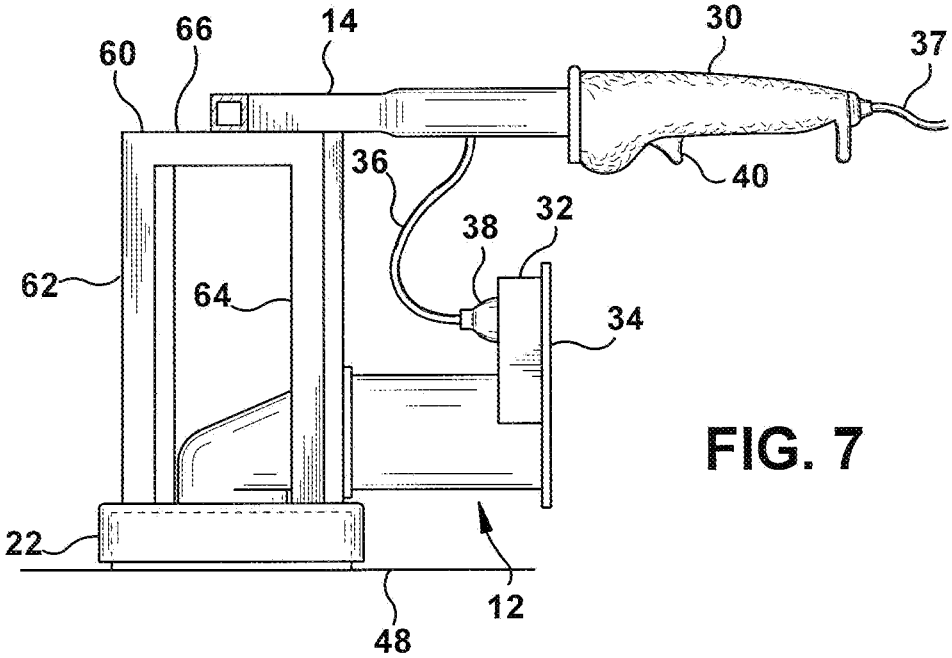
FIG. 7 is a cross-sectional view along and in the direction of arrows 7-7 shown in FIG. 6.

FIGS. 6 and 7 show a third embodiment where vertical tube 26 is replaced by a U-shaped frame 60 having two vertical tubes 62, 64 which are secured to dust shroud 18. The horizontal joiner 66 which links tubes 62, 64 is preferably positioned at about 45 degrees to handles 14, 16. Handles 14, 16 are welded to joiner 66 as clearly seen in FIG. 7. This embodiment has no height adjustment as shown but a telescopic arrangement for tubes 62, 64 would allow for adjustability.

The embodiments shown relate to the use of an existing angle grinder which is split to form the completed product. In order to provide a more aesthetic product hand tool support 10 and grinder 12 could be integrated into a new product rather than a conversion from an existing grinder. Integration would remove socket 32 and lead 36 as they could be hidden from view. Integration would also allow for further advances in the balancing of the product.

Figure 8:
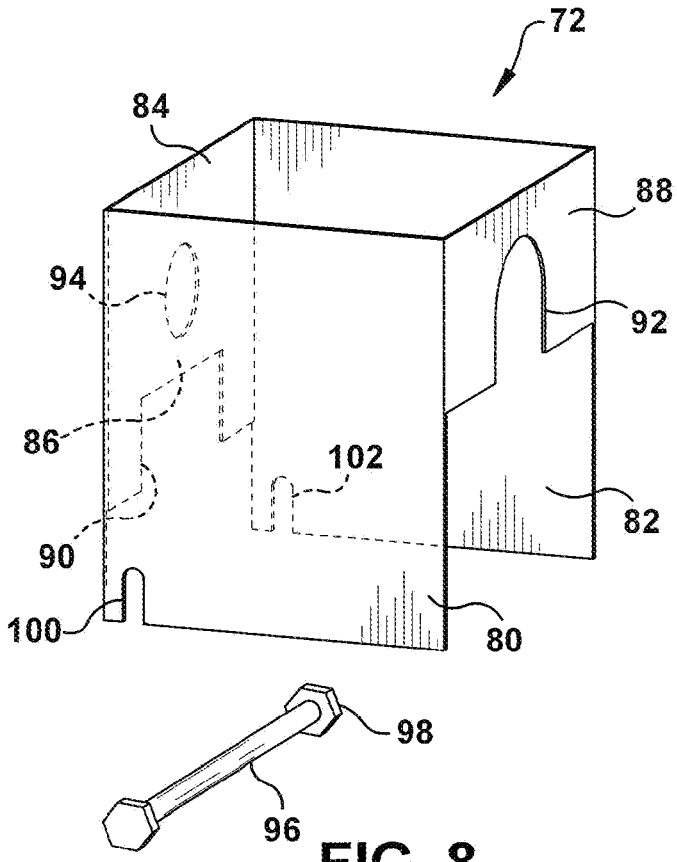
FIG. 8 is a perspective view of an embodiment of a switch clamping device made in accordance with the invention.
Figure 9:
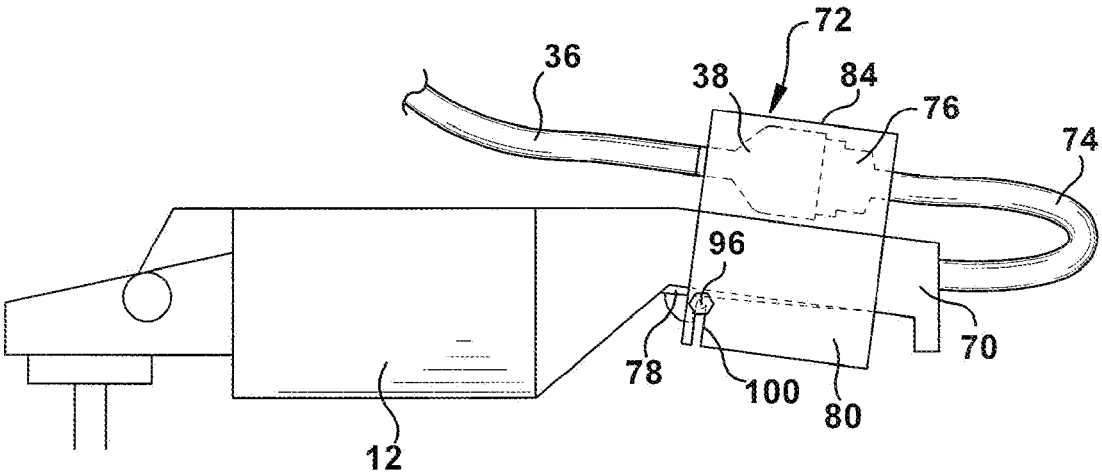
FIG. 9 is a side view of the switch clamping device of FIG. 8 attached to an angle grinder.

It is not necessary to split angle grinder 12 if an alternate means is provided to allow power lead 36 to be connected to angle grinder 12 in a safe manner. In order for the switch 40 on trigger grip 30 to activate angle grinder 12, the trigger switch of the angle grinder must be in the "ON" position. This is unsafe if plug 38 is exposed which will allow unswitched power to be connected inadvertently causing sudden start up of angle grinder 12. FIGS. 8 and 9 show an embodiment of a switch clamping device 72 which is attached to the standard handle 70 of angle grinder 12 to alleviate this safety problem. Angle grinder 12 has a power lead 74 with a socket 76 which mates with plug 38 from power lead 36. Angle grinder 12 has a trigger switch 78 for activating and deactivating electrical power thereto.

Switch clamping device 72 has a housing of U-shaped construction with side arms 80, 82 and base 84. Ends 86, 88 are located between side anus 80, 82 and prevent escape of socket 76 and plug 38. Slot 90 is shaped to conform to the shape of handle 70 in a saddle-like manner. Slot 92 and aperture 94 allow respective leads 74, 36 to pass through. To complete switch clamping device, there is provided a threaded rod 96 having a lock nut 98 which is located in slots 100 102 of side arms 80, 82. Side arms 80, 82 are of a sufficient length to hold socket 76 and plug 38 on handle 70 and to project past trigger switch 78.

In use, socket 76 and plug 38 are coupled together and placed on top of handle 70. Side arms 80, 82 slide over socket 76 and plug 38 and handle 70 to capture socket 76 and plug 38 therebetween as shown in FIG. 9. Threaded rod 96 is more upwardly in slots 100, 102 until trigger switch 78 is depressed to the "on" position and lock nut 98 is tightened. Socket 76 and plug 38 will be clamped to handle 70 and electrical power can be supplied to grinder 12 when switch 40 on trigger grip 30 is activated. Thus switch clamping device 72 will provide a connection to hand tool support 10 which is simple to apply and non-destructive. The electrical connection between socket 76 and plug 38 will be retained because they are contained within the housing thus preventing unswitched power connection to plug 38 while trigger switch 78 is clamped in the "ON" position. Any angle grinder 12 can be utilised without alteration to the angle grinder 12 per se. Although this embodiment has a particular use with hand tool support 10 it is not limited to that application. The switch clamping device 72 can be applied to other situations where remote activation of an electrical appliance fitted with a trigger switch is required. The shape and particular configuration of the switch clamping device 12 can be varied to suit requirements as would be understood by the man skilled in the art.

Figure 10:
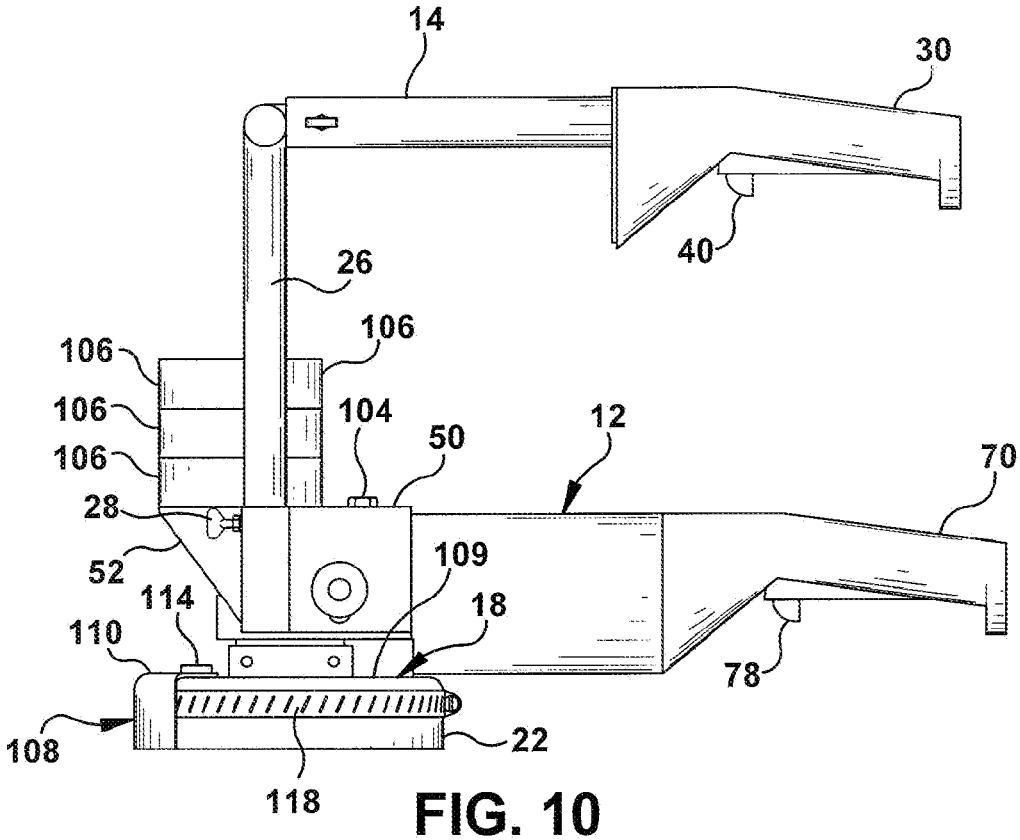
FIG. 10 is a side view of the angle grinder shown in FIG. 9 fitted to a fourth embodiment of a hand tool support.
Figure 11:
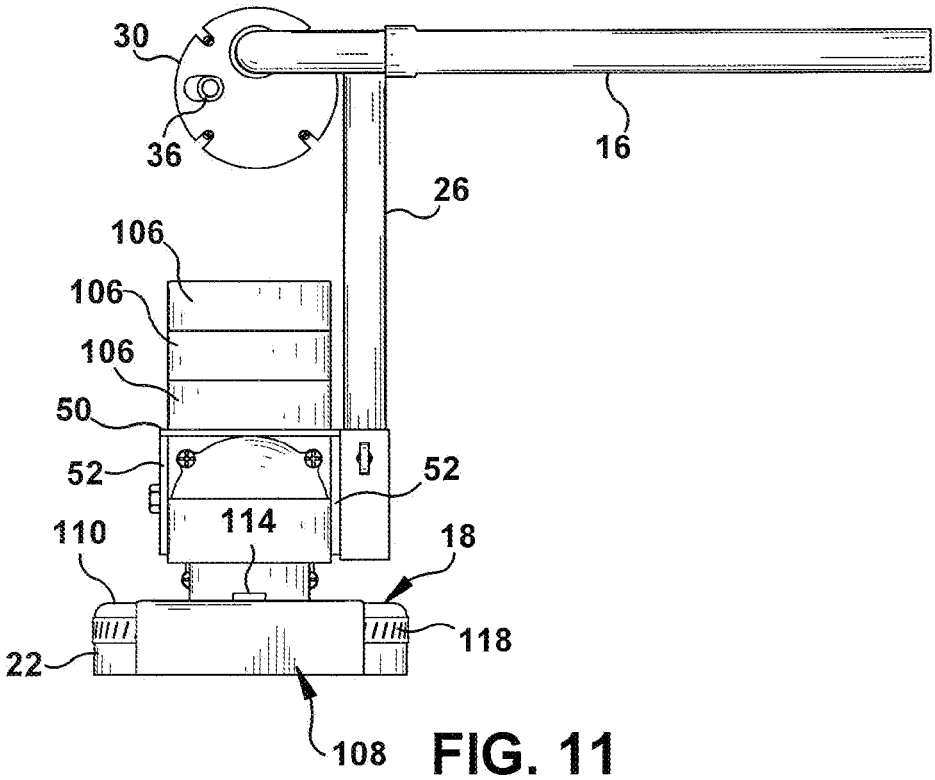
FIG. 11 is a front view of FIG. 10.
Figure 12:
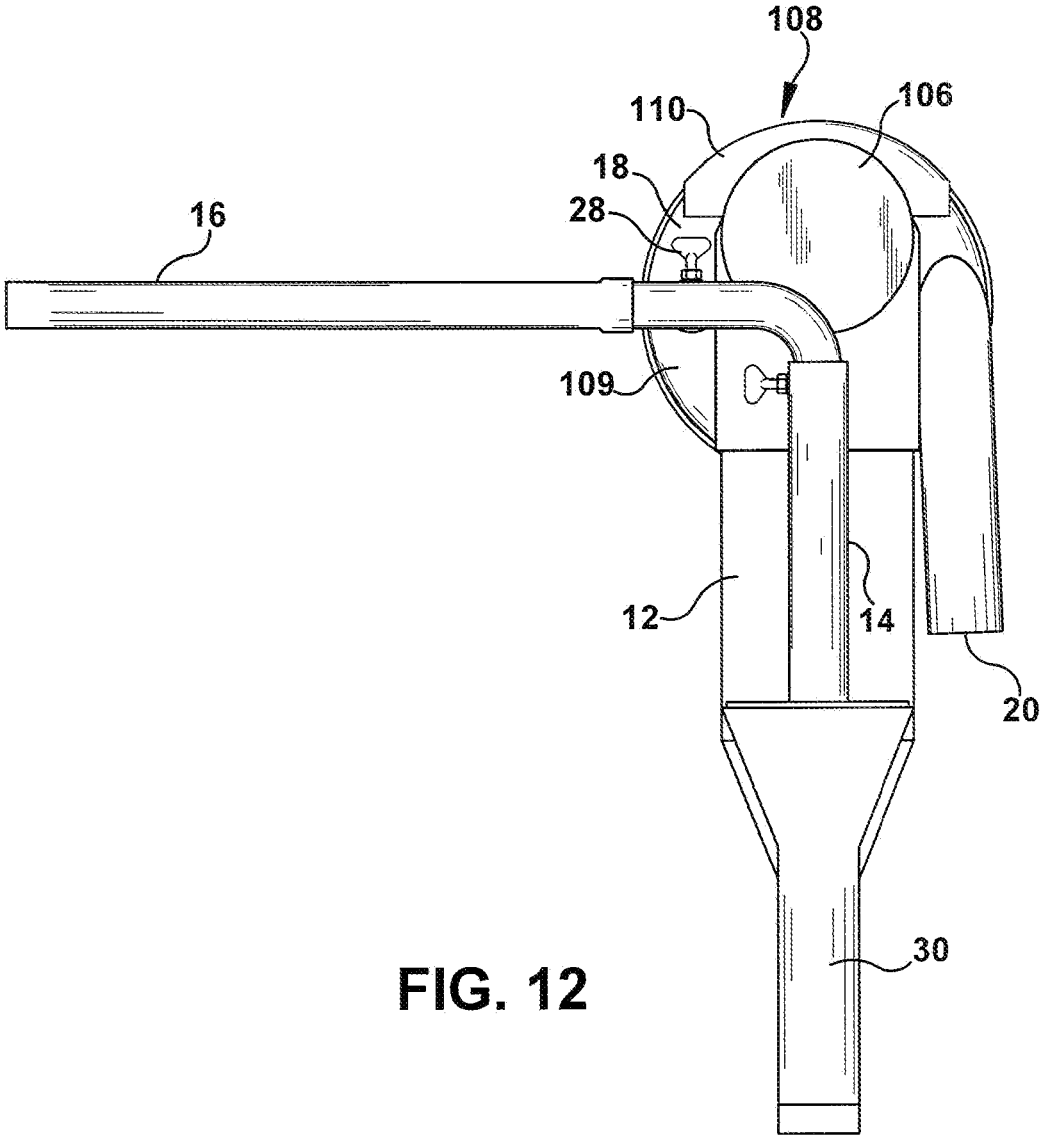
FIG. 12 is a plan view of FIG. 10.

In FIGS. 10 to 12 a variation of the hand tool support shown in FIG. 5 is shown using the angle grinder 12 shown in FIG. 9. Tube 26 is attached to one of side members 52 and is offset from the centre of the grinding disc (not shown) of grinder 12. The intersection of handles 14, 16 will accordingly be offset. As tube 26 has been shifted from the top of bracket 52 (FIG. 5) to one of side members 52 (FIG. 11), additional stability is obtained by the addition of a securing bolt 104. Weights 106 can also be fitted, as required to the top of bracket 52 to act as a counterbalance for the weight of angle grinder 12. The weights 106 will also assist in the cutting action of angle grinder 12. A downward force is not required by the operator and different weights can be used to suit conditions.

FIGS. 10 to 18 also illustrate the use of separate arcuate segment 108 which is illustrated in FIGS. 13 to 15 and 17, and is part of dust shroud 18. Segment 108 has a top plate 110 which slides over the top of the substantially circular base plate 109 of dust shroud 18. A slot 112 is provided to allow segment 108 to be clampingly engaged to the top of base plate 109 by nut 114. A curved section 116 depends downwardly from top plate 110. The arcuate segment 108 will cover a flattened segment 111 of the depending flange 113 from base plate 109 to which band clamp 118 is secured to hold rubber skirt 22. The flattened segment will allow the grinding disc (not shown) to assist with edging operations. A rubber skirt 115 is also attached to curved section 116 to provide a sealing effect for dust control. In order to assist with edging operations handle 16 may be configured to be adjustable in its orientation. For edging operations handle 16 can be adjusted to be parallel with handle 14 to allow the operator to get closer without handle 16 bumping into a wall. The flexible rubber skirt 22 includes a small cut out section 117 to allow the edge of the grinding disc to protrude therethrough in its flattened segment 111.

By extending the depending flange 113 across the flattened segment 111 it allows rubber skirt 22 to surround the entire periphery of shroud 18 including the flattened segment 111. A small opening 117 is required for the grinding disc to protrude through rubber skirt 22. In this way a much improved air velocity and shielding of the flattened segment 111 achieved compared to a fully open flattened section. The use of a height adjustable rubber skirt 22 mounted on a solid shroud 18 provides advantages of the prior art. This is important because it provides a seal for the shroud that can be height-adjusted quickly for different sized discs that may be attached to the grinder 12 so that the seal is not causing friction on the surface to be abraded. This lack of friction is what gives the grinder the "floating" sensation and allows it to be used with handles above the angle grinder at approximately adult seating height. Most seats of chairs are at a height of 35 cm to 50 cm depending on the personal height of the operator. The handles are preferably at or near the seat height of the operator. A typical height would be 40 cm. If the flexible skirt had medium to strong friction with the floor it would cause angle grinder 12 to be tilted by operator 42 pushing on the raised handles which would tilt the grinding disc making it dig into the surface rather than float across it. When edging operations have been completed, the arcuate segment 108 can be clamped to dust shroud 18 by nut 114.

Figure 19:
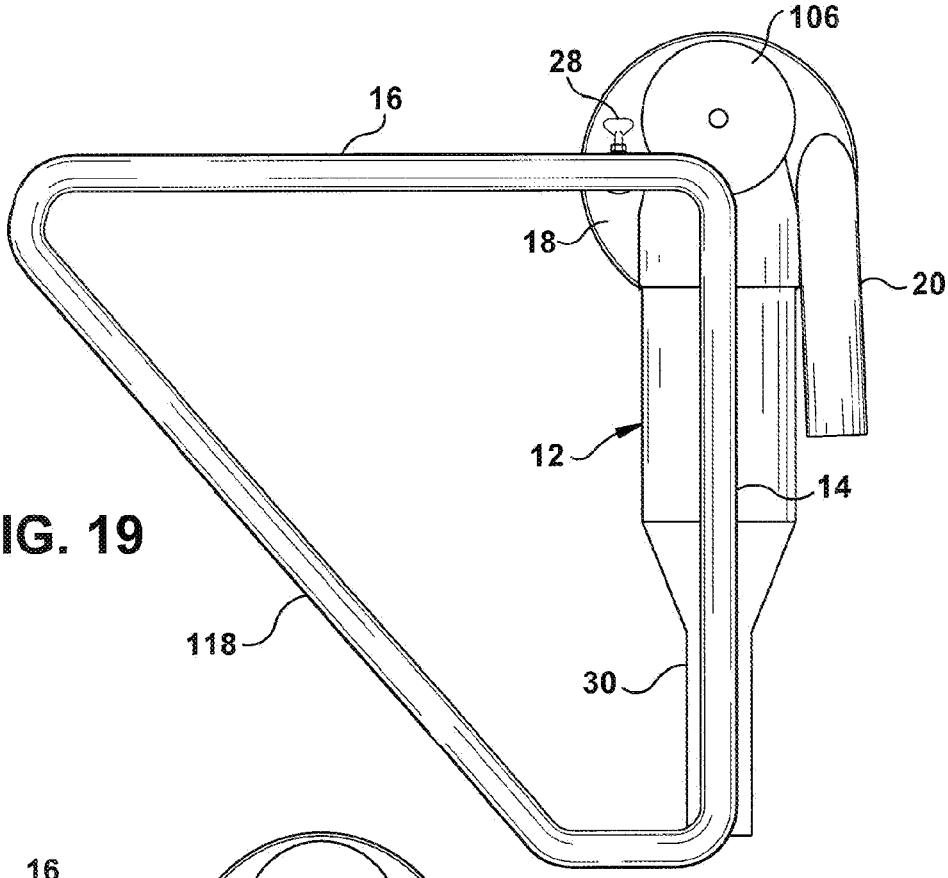
FIG. 19 is a plan view of the hand tool support shown in FIG. 12 with a variation of the shape of the handles.
Figure 20:
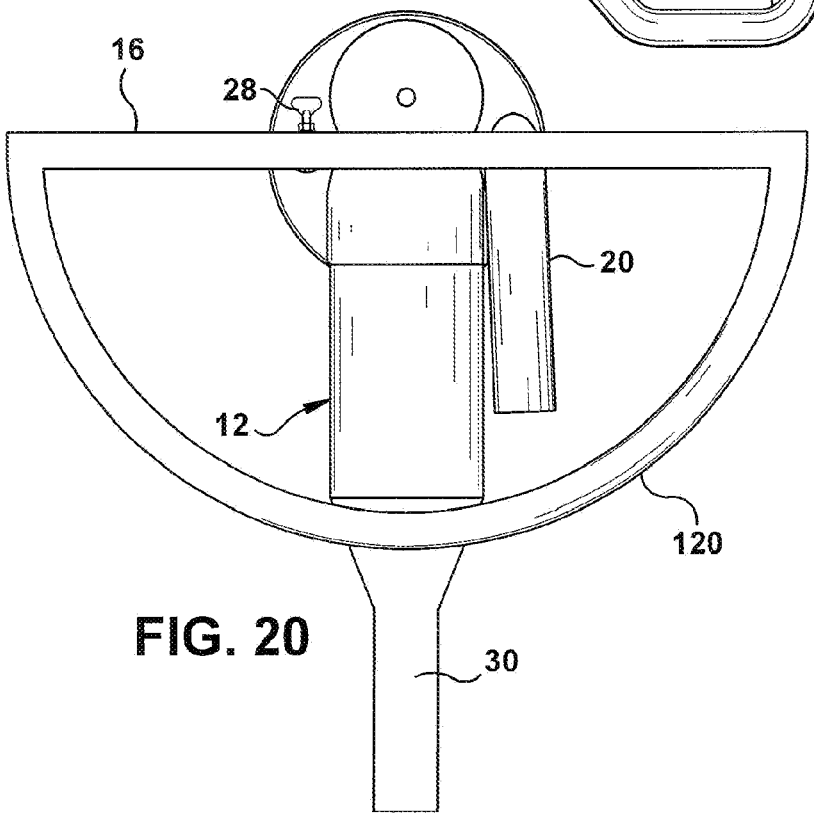
FIG. 20 is a plan view of the hand tool support shown in FIG. 12 with a variation of the shape of the handles.

Variations of handles 14, 16 can be used. In FIG. 19 handles 14, 16 are shown forming a triangular loop with the hypotenuse section 118. In FIG. 20 handle 16 is extended on both sides and is connected by a semi-circular section 120.

Figure 21:
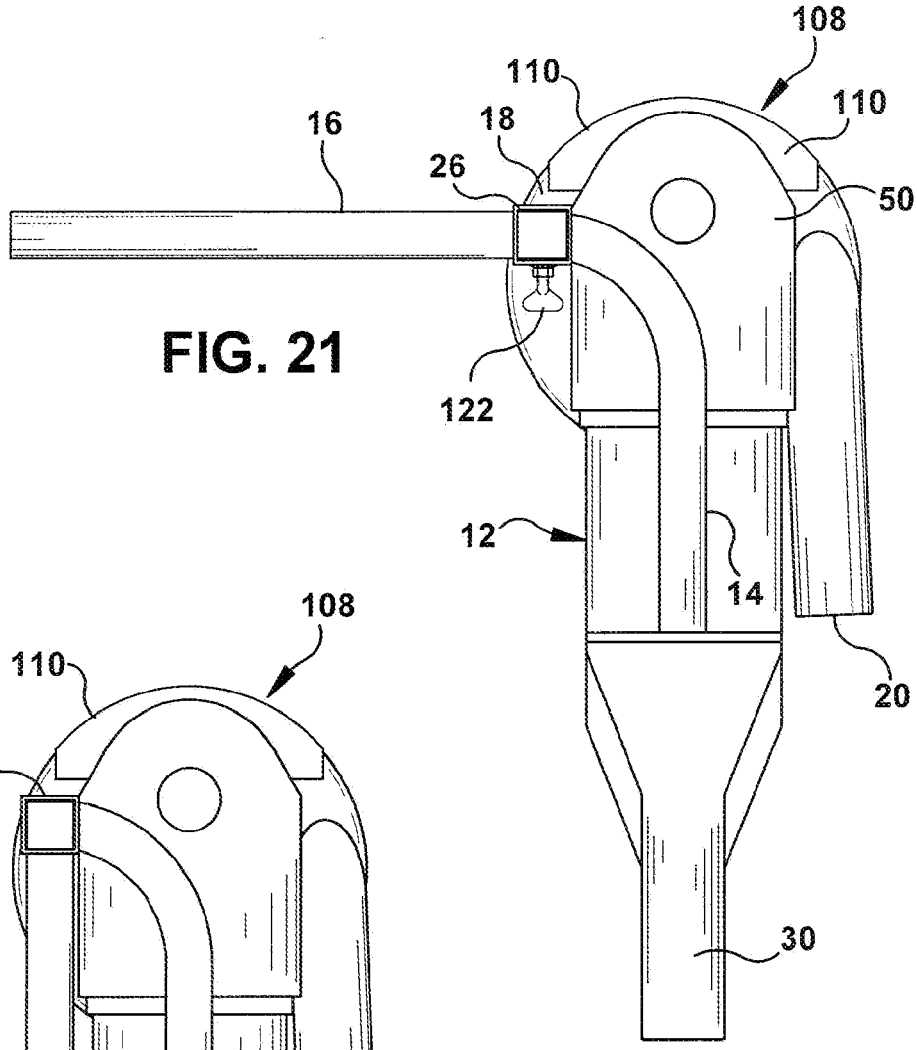
FIG. 21 is a plan view of the angle grinder shown in FIG. 9 fitted to a fifth embodiment of a hand tool support with the handles at right angles.
Figure 22:
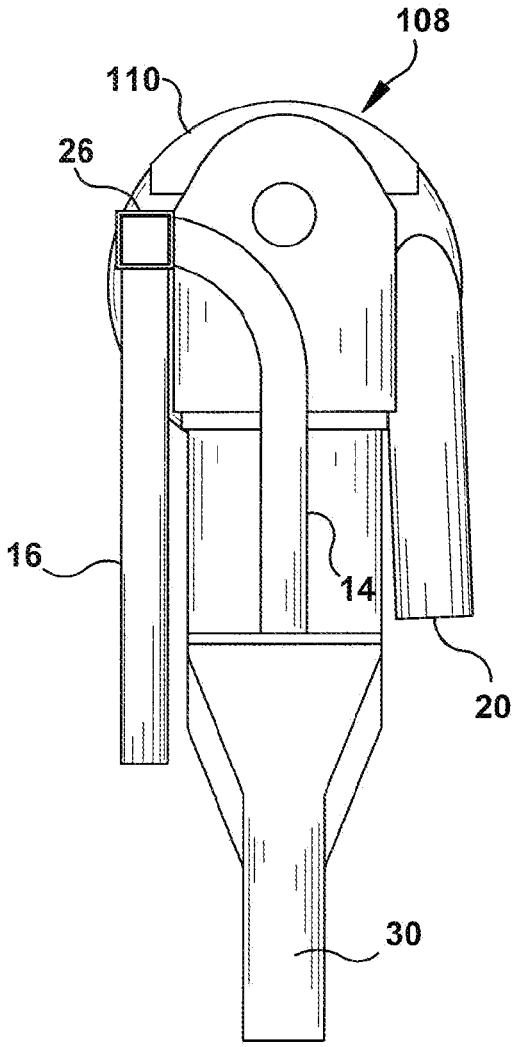
FIG. 22 is a similar view to that of FIG. 21 with the handles in a parallel position.

In the embodiment shown in FIGS. 21 and 22, handle 16 can be moved from the position shown in FIG. 21 to the position shown in FIG. 22. Handle 16 has a stub section (not shown) on its bottom surface which slides into the hollow section of tube 26. The stub section is held fast by screw 122. Screw 122 can be loosened to allow the stub section to be withdrawn from tube 26 and replaced when handle 16 is rotated to the position shown in FIG. 22. This adjustment will allow operator 42 to get closer to the wall without bumping into the wall.

Figure 23:
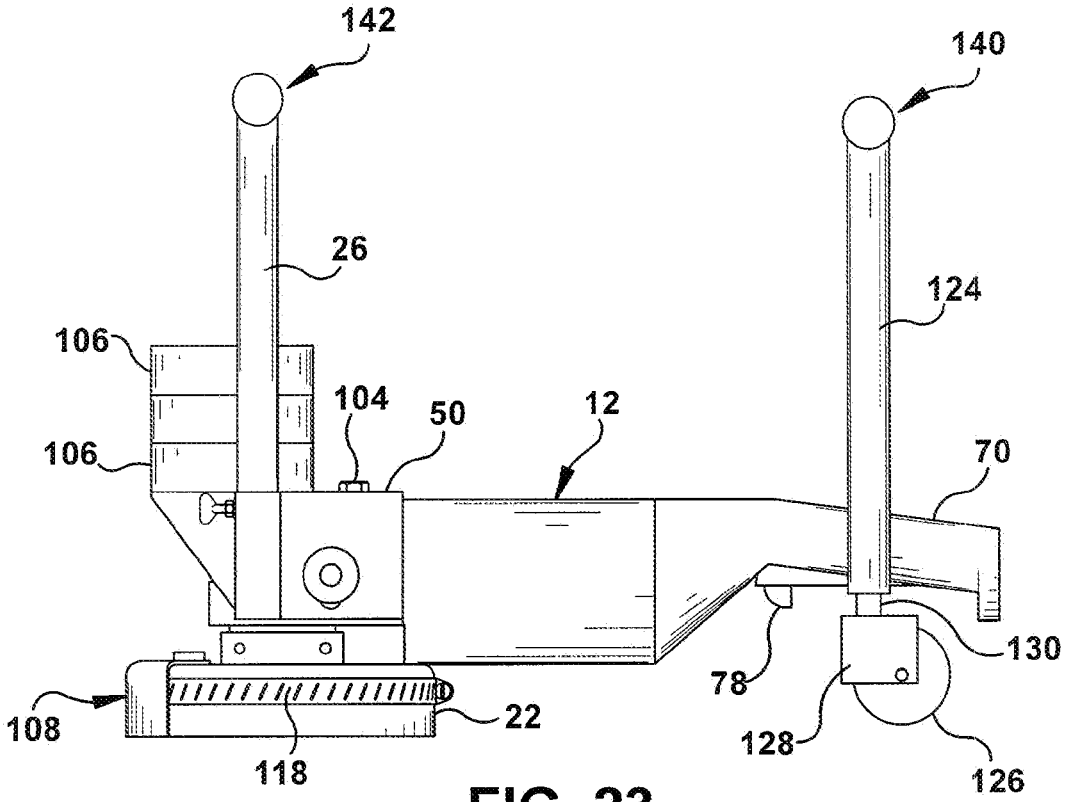
FIG. 23 is a side view of a sixth embodiment of a hand tool support.
Figure 24:
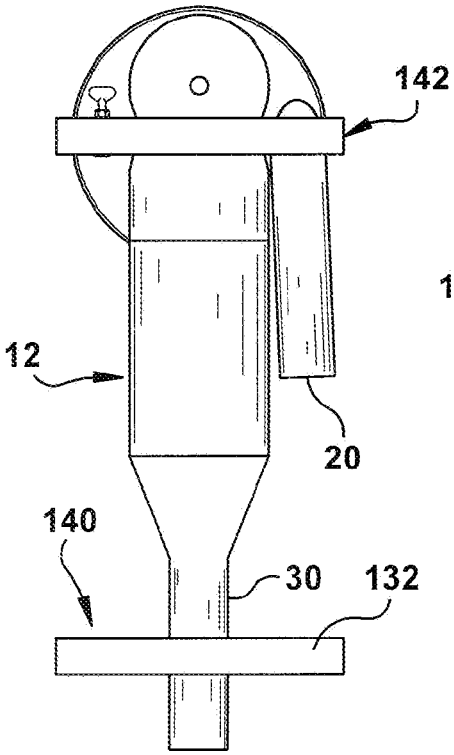
FIG. 24 is a plan view of FIG. 23.
Figure 25:
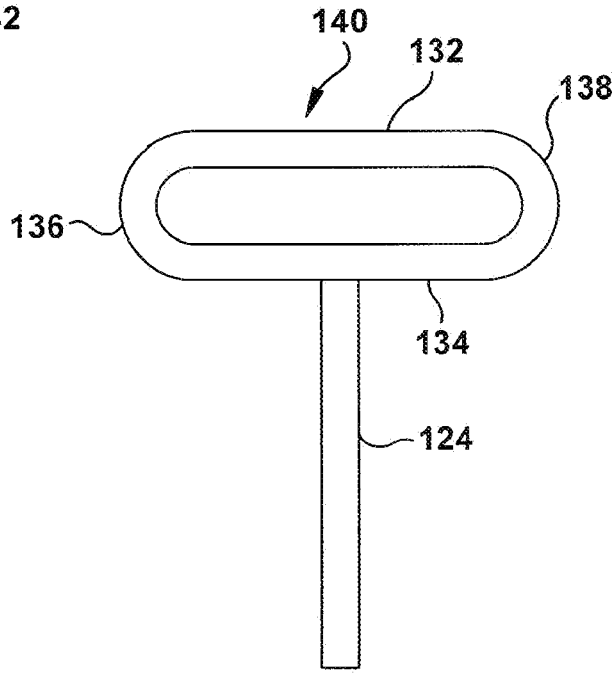
FIG. 25 is a side view of the handles used in FIG. 23.
Figure 26:
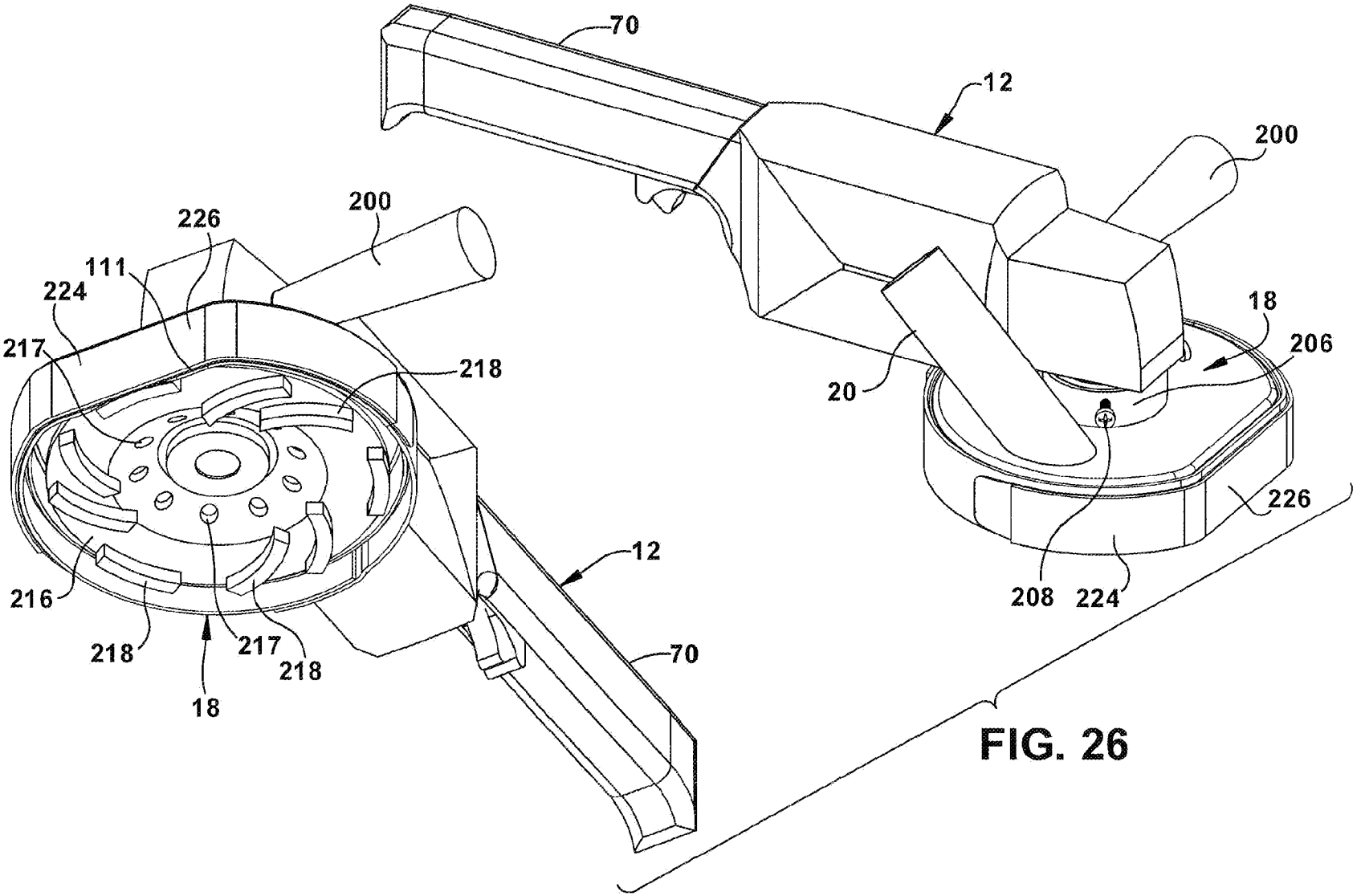
FIG. 26 shows upper and lower perspective views of a further embodiment of a grinder with a dust shroud.

In the embodiment shown in FIGS. 23 to 25 a second tube 124 is attached to the handle 50 of angle grinder 12. A dolly wheel 126 is attached to tube 124 by a bracket 128 and stub axle 130. A loop formed by two parallel arms 132, 134 and arcuate links 136, 138 will form a rear handle 140. A front handle 142 will similarly be attached to tube 26.

FIGS. 26, 27, 32 and 33 show a further embodiment of an angle grinder 12 with handle 70 and side arm 200. Angle grinder 12 has an annular bearing 202 through which the drive shaft 204 protrudes. Dust shroud 18 is fitted to angle grinder 12 by an annular section 206 which opens into dust shroud 18. Set screws 208 are threaded into annular section 206 and will clamp against annular bearing 202 when bearing 202 is inserted into annular section 206. As the diameter of the annular bearing 202 can vary between different grinders 12 a set of collars 210, 212, 214, 215 of differing thicknesses may be used. The appropriate one of collars 210, 212, 214 or 215 can be fitted to bearing 202 to suit grinder 12. By providing the collars 210 to 215, the inner diameter of annular section 206 can remain constant and differing sizes of dust shroud 18 are not required for each grinder. The collars 210, 212, 214, 215 are highly effective at closing air gaps between the bearing 202 and the dust shroud 18, and thus increase the vacuum pressure within the shroud and the dust removal efficiency.

Grinding discs of the types used with the described abrading tools around the world vary in diameter from 170 mm to 180 mm, but are mostly around 175 mm which causes a problem when edging against a wall. If the disc is 173 mm diameter instead of 175 mm there will be a grinding gap of 1 mm (the disc will be 1 mm back from the outside of seal band 220 and leave a 1 mm un-ground line along the wall) and if it is 177 mm the disc will protrude through the seal band 220 and eat into the cover band 224 by 1 mm. If a disc is 4 mm under 175 mm diameter it will leave a 2 mm gap and if it is 4 mm more than 175 mm diameter it will eat into the cover band by 2 mm.

To adjust for this there is provided one or more collars 215 with eccentric centers or openings. The eccentric collars 215 will have the inner circle or opening centre offset to the outer diameter centre so that the collar can be rotated to shift the grinder mounting position forward or backward, or to either side so that the edge of the grinding disc 216 is positioned correctly with respect to the shroud 18.

Figure 16:
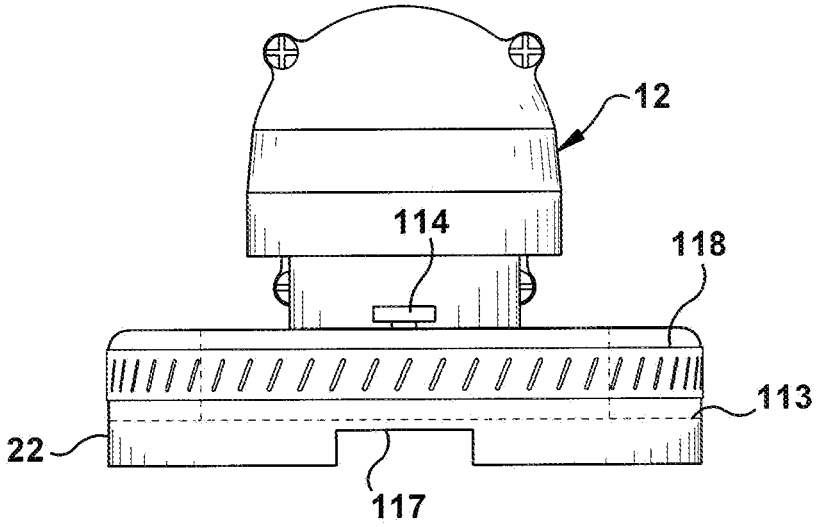
FIG. 16 is a similar view to that of FIG. 11 with the separate arcuate segment removed.
Figure 17:
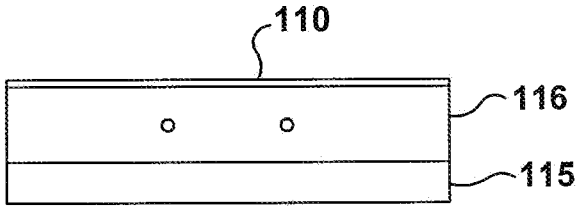
FIG. 17 is front view of the separate arcuate segment of the dust shroud of FIG. 13.
Figure 18:
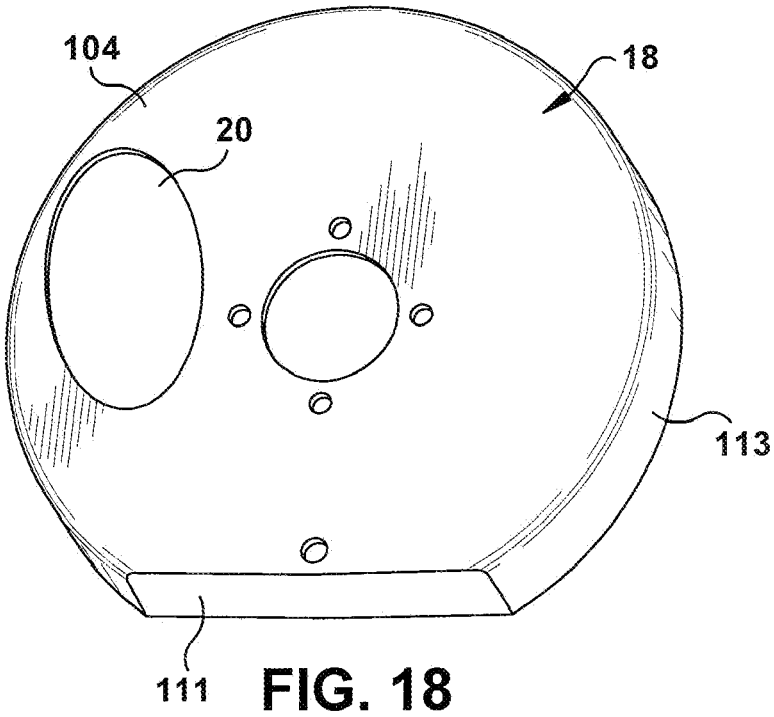
FIG. 18 is a plan view of a dust shroud of FIG. 13 with the separate arcuate segment removed.
Figure 27:
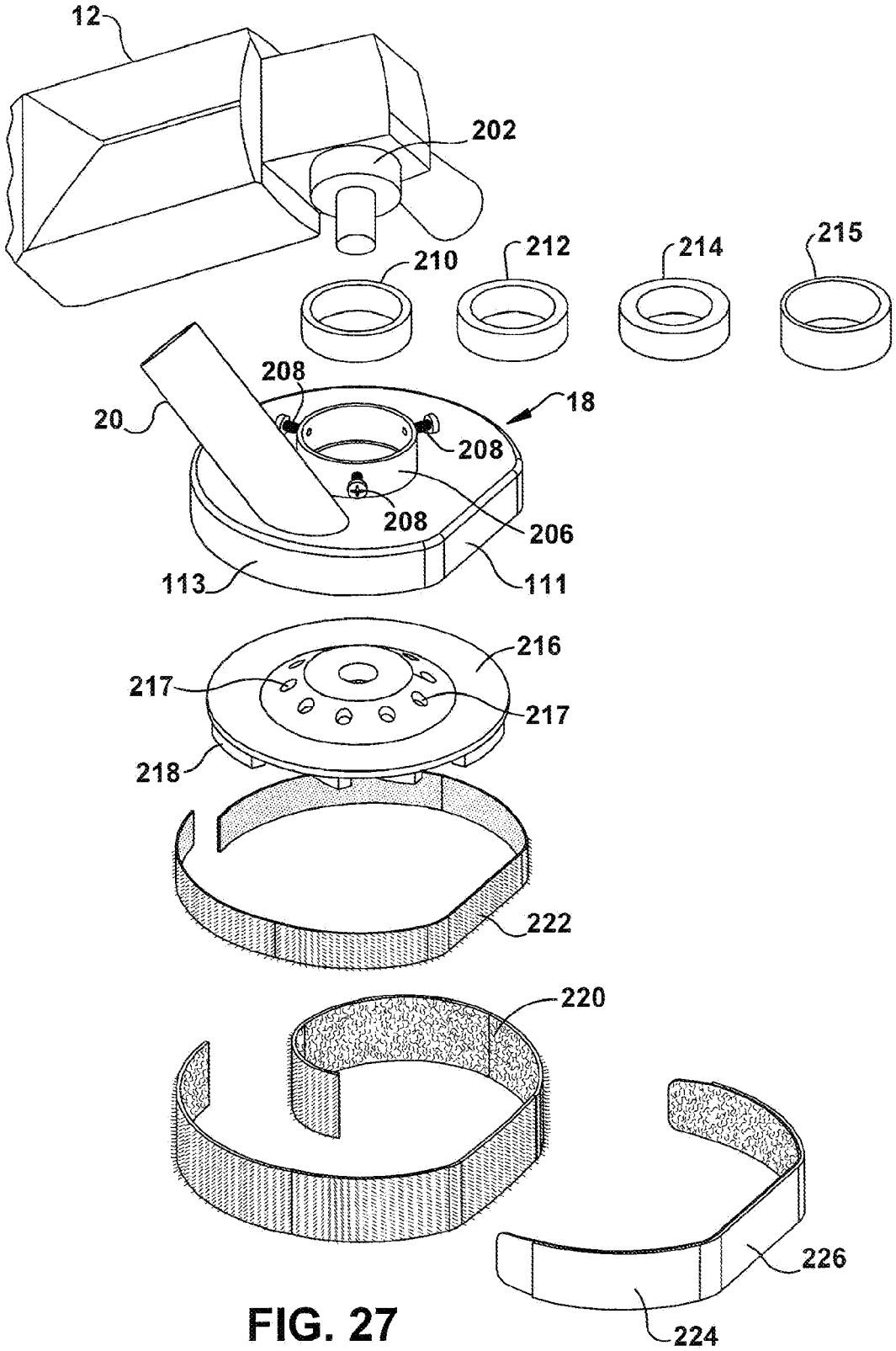
FIG. 27 is an exploded perspective view of the dust shroud shown in FIG. 26.

FIG. 27 does not show the small cut out section 117 of FIG. 16 as that can be created once the grinder 12 has been selected. Grinding disc 216 can be of any type of construction.

The preferred embodiment shows grinding disc 216 having spiral flutes 218 which have an abrasive on their outer surface. The shape of the spiral flutes 218 allows abraded material not to be trapped between the floor and the grinding disc and holes 217 in grinding disc 216 assist in the removal of the abraded material through outlet pipe 20.

Figure 13:
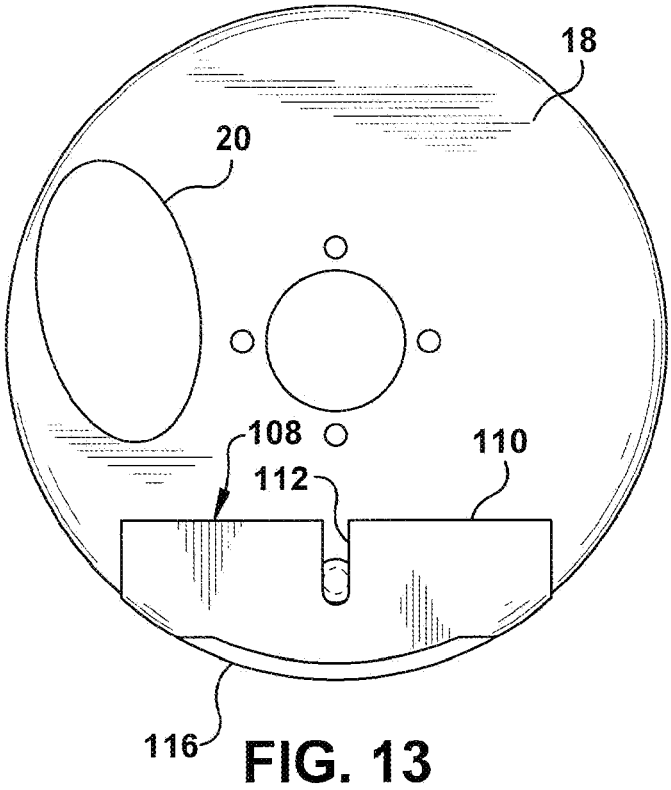
FIG. 13 is a plan view of a dust shroud made in accordance with the invention.
Figure 14:
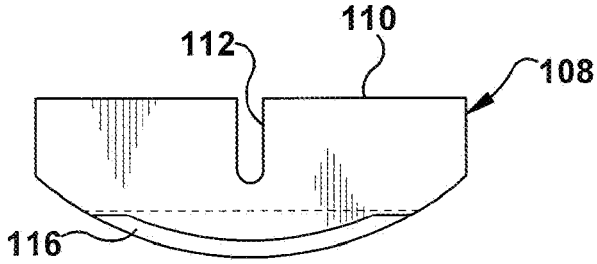
FIG. 14 is a plan view of a separate arcuate segment of the dust shroud of FIG. 13.
Figure 15:
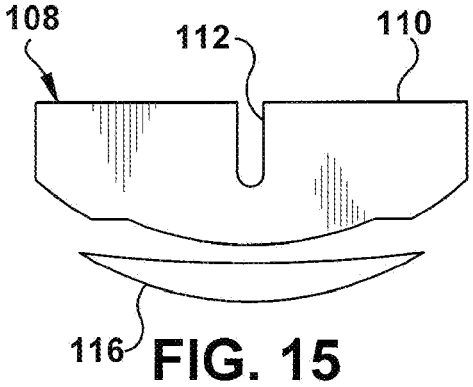
FIG. 15 is a disassembled plan view of the separate arcuate segment shown in FIG. 14.

This embodiment provides a variation of the rubber skirt 22 and band clamp 118 shown in FIG. 16. Rubber skirt 22 is replaced by a seal band 220, a peripheral flexible skirt, which releasably attaches to a shroud band 222 which is adhered to the depending flange 113 of the shroud 18. In this manner, the peripheral flexible skirt, in the form of seal band 220, is attached to and depends from the depending flange 113 of the shroud 18, and can be selectively positioned with respect to the depending flange 113 and with respect to the grinding surface of a grinding disc of the abrading tool. Seal band 220 and shroud band 222 are typically formed from a pair of hook and loop fasteners, for example those sold under the Velcro trade mark. Shroud band 222 is adhesively affixed to depending flange 113 and seal band 220 can be positioned accurately on shroud band 222 without requiring a band clamp 118. A slot cut-out 221, FIGS. 33 and 34, similar to cut-out 117 will automatically be cut by grinding disc 218 to form slot 223 when first used. The grinding disc 216 only protrudes radially beyond the flattened segment 111 a small distance, i.e. equal to a combined thickness of the shroud band 222 and seal band 220. Segment 108 of FIGS. 13 to 15 is replaced by a cover band 224 when edging operations are not needed. Cover band 224 can be of stiff or flexible material and has a flattened section 226 which matches flattened segment 111. The cover band 224 behaves as a hook and loop fastener with seal band 220. The construction of the shroud band 222, seal band 220 and cover band 224 allows an easy operation when switching from edge to floor grinding and for height adjustment without requiring tools.

The sealing across the flattened segment 111 by seal band 220 together with the rigidity of the flattened segment 111 provides a minimal opening in seal band 220. An opening is formed by the periphery of a grinding disc 216 which preferably contacts the seal band 220 and creates the opening by spinning contact with the seal band 220. The opening is therefore preferably no larger than the profile of the outermost peripheral edge of the grinding disc 216. This minimal opening provides more vacuum pressure within the shroud for a given size of vacuum pump (not shown). The rigidity of the shroud will result in the maintaining of a seal above the surface to be abraded which creates little friction with the surface. Preferably, the bottom edge of the seal band 220 is for example 1 mm above the work surface, so that air is drawn under the seal band 220 by the vacuum pressure created by vacuum pump attached by a hose to the dust shroud 20. The opening in the seal band 220 through which the grinding disc protrudes is made by the grinding disc as small as possible, which minimizes the escape of dust or abraded material from the shroud.

Figure 32:
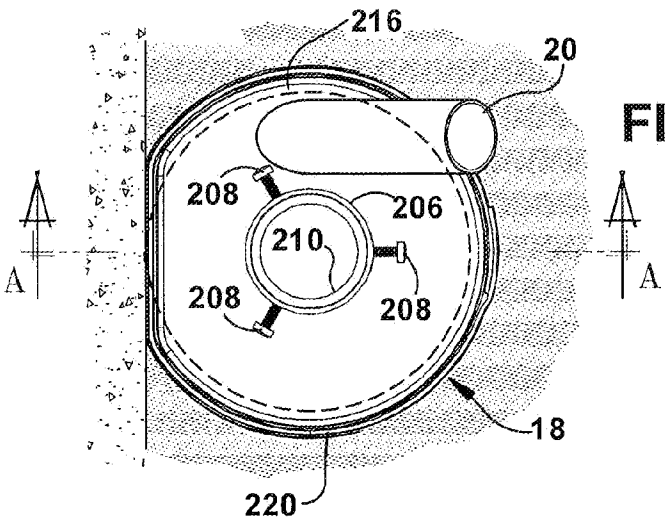
FIG. 32 is a plan view of the shroud of FIG. 27 showing the grinding of a wall.
Figure 33:
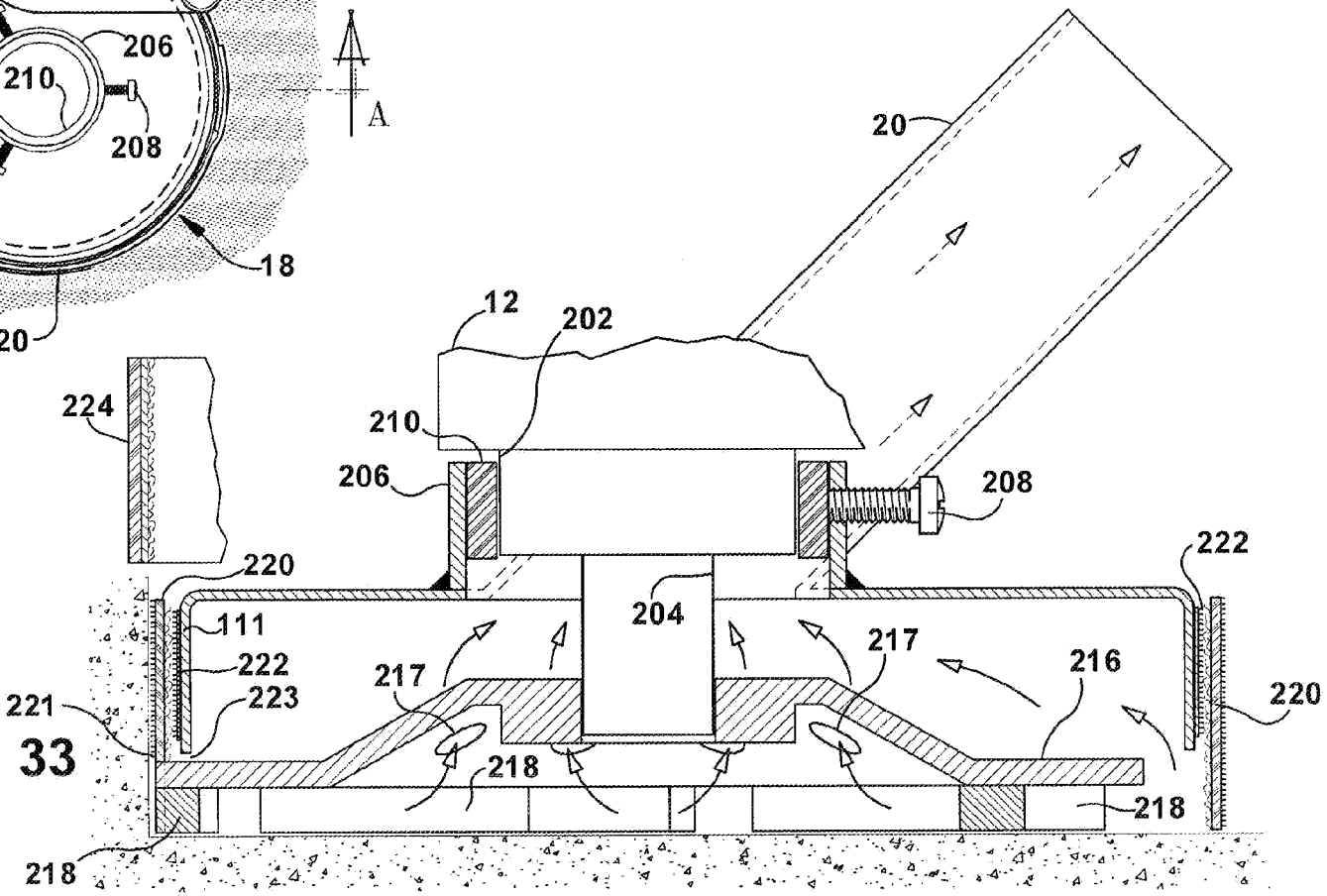
FIG. 33 is a cross-sectional view along and in the direction of arrows A-A shown in FIG. 32.

FIGS. 32 and 33 show the edging operation and how the edge of the grinding disc 216 protrudes through cut-outs 221, 223 in the seal band 220 and the shroud band 222 respectively to abrade the wall. Note that the cut-outs 221 and 223 are as small as possible, being formed by the profile of the protruding edge of the grinding disc 216 (and outermost flutes 218 if present).

In this manner, the peripheral flexible skirt can be positioned, for example, 1 mm above the grinding surface, so that the edge of the peripheral flexible band is not in direct contact with the grinding surface so as to cause excessive friction which would increase resistance to motion of the grinding disc over a surface. Also, the small gap achievable by adjustment of the seal band 220 allows sufficient air flow into the dust shroud for efficient vacuum operation through the dust shroud. And furthermore, the minimization of the opening in the flattened segment of the peripheral flexible skirt, i.e. in the seal band formed by the edge profile of the grinding disc minimizes the escape of dust from the dust shroud.

Figure 28:
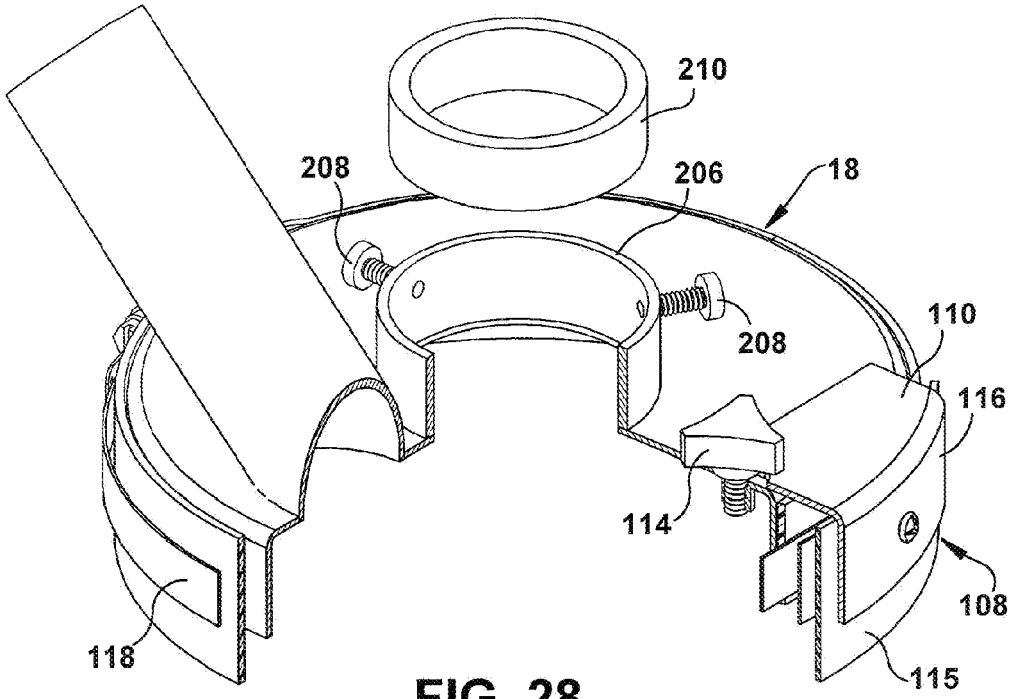
FIG. 28 is partial cross-sectional perspective view of a further dust shroud.
Figure 29:
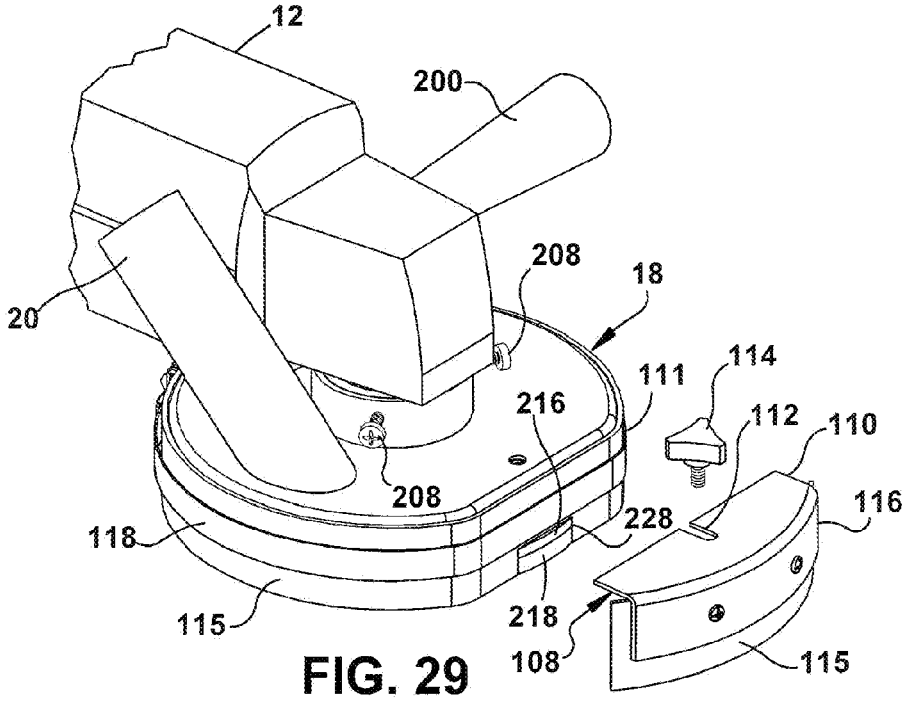
FIG. 29 is a partial exploded perspective view of the shroud shown in FIG. 28.
Figure 30:
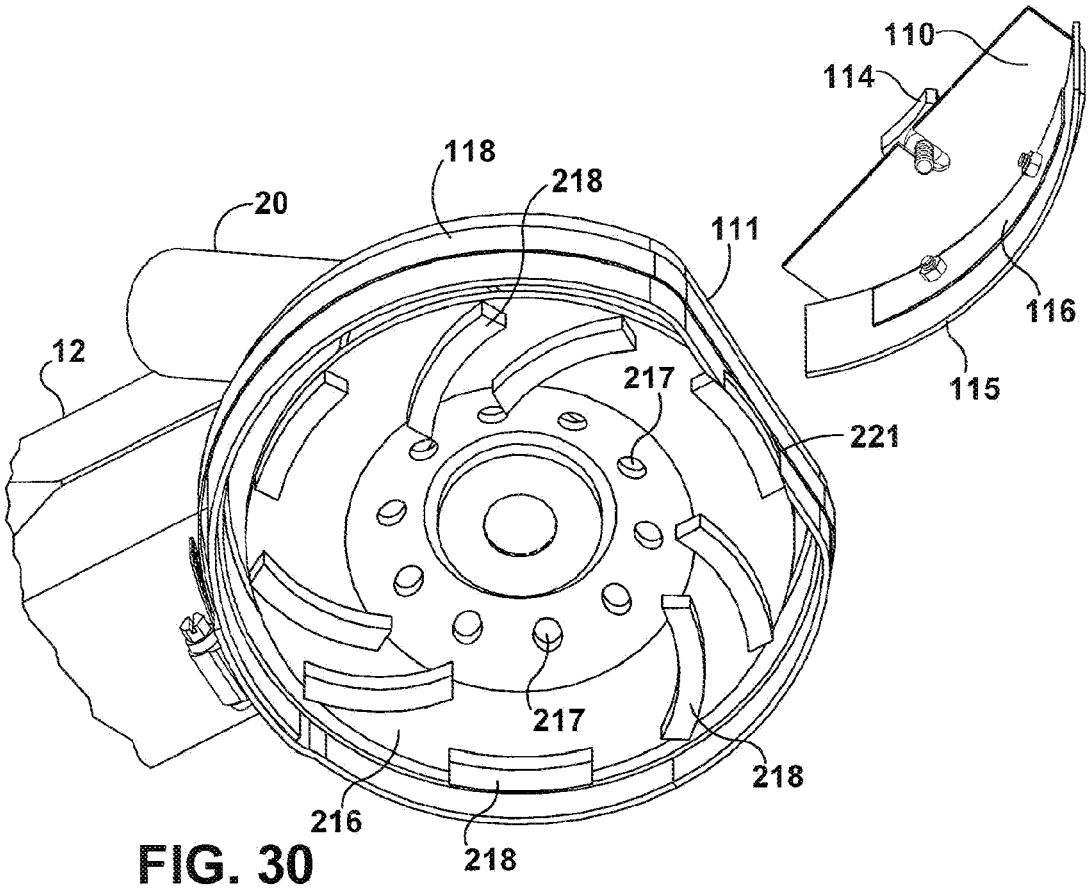
FIG. 30 is an underneath perspective view of the shroud shown in FIG. 29.
Figure 31:
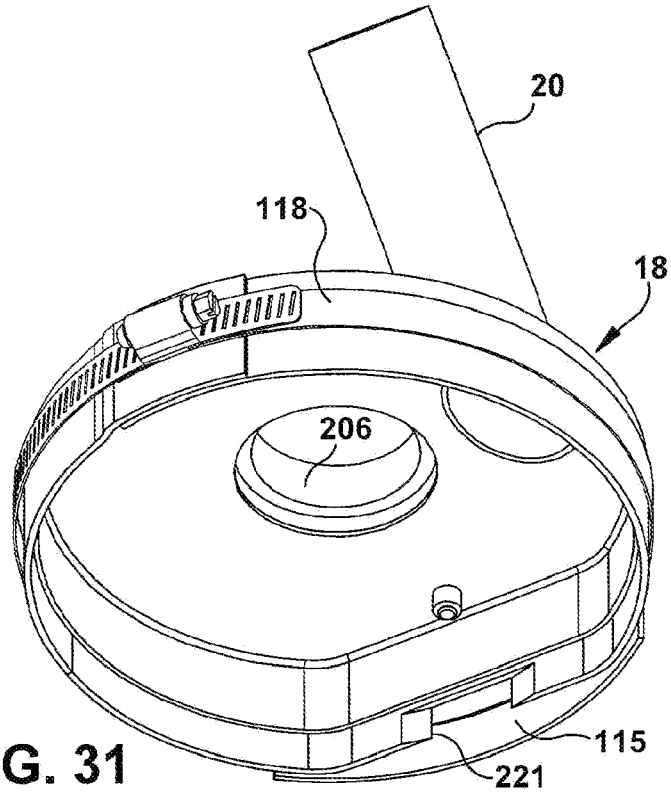
FIG. 31 is a similar view to that of FIG. 30 but rotated further to showing the cut out.

A further embodiment is shown in FIGS. 28 and 29. This embodiment is a combination of the embodiments shown in FIGS. 13 to 18 and FIGS. 26, 27, 32 and 33. FIGS. 28 and 29 illustrate the embodiment of FIGS. 13 to 18 using the band clamp 118 for height adjustment and the flexibility of the annular section 206 on the shroud with the collar 210 of FIGS. 26, 27, 32 and 33. The operation and construction of this embodiment has been described previously. A cut-out 228 is seen in the seal band or rubber skirt 115 through which grinding disc 216 slightly protrudes. Cut-out 228 is formed by grinding disk 216 when first used in the shroud to cut through the rubber skirt seal band 115 which extends over the flattened segment 111. This will reduce the size of the cut-out to reduce loss of vacuum.

Figure 34:
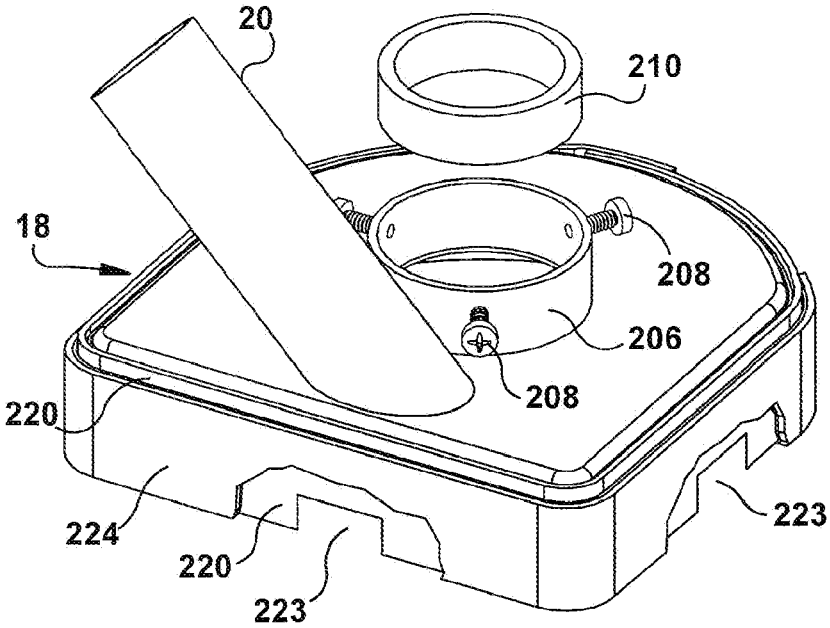
FIG. 34 shows upper and lower perspective views of a further shroud.
Figure 34:
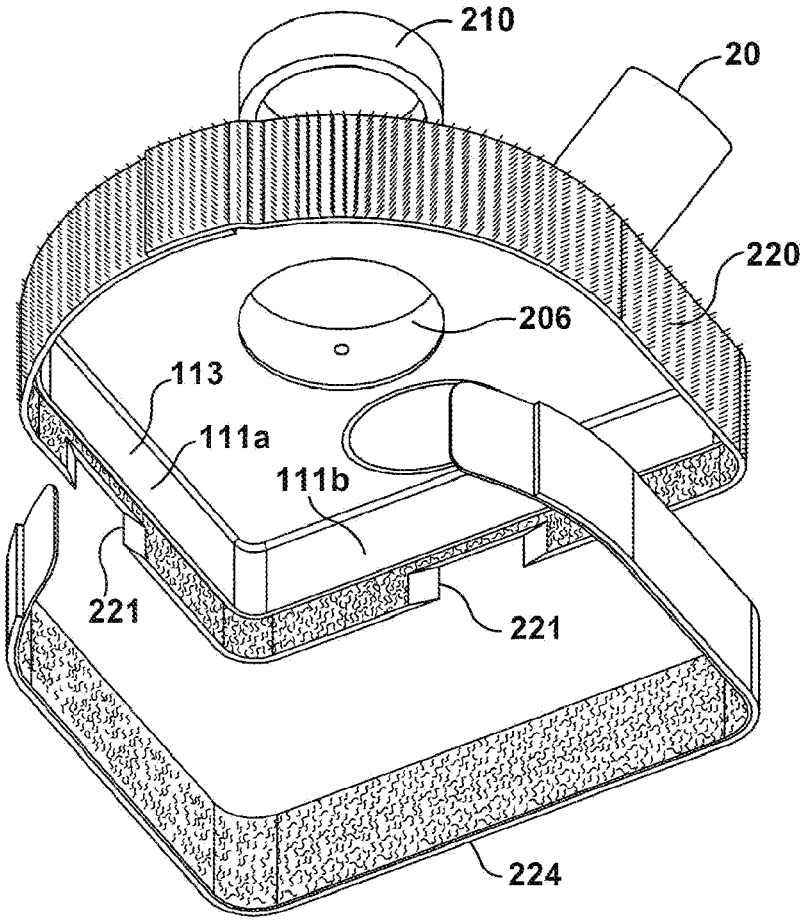
Figure 35:
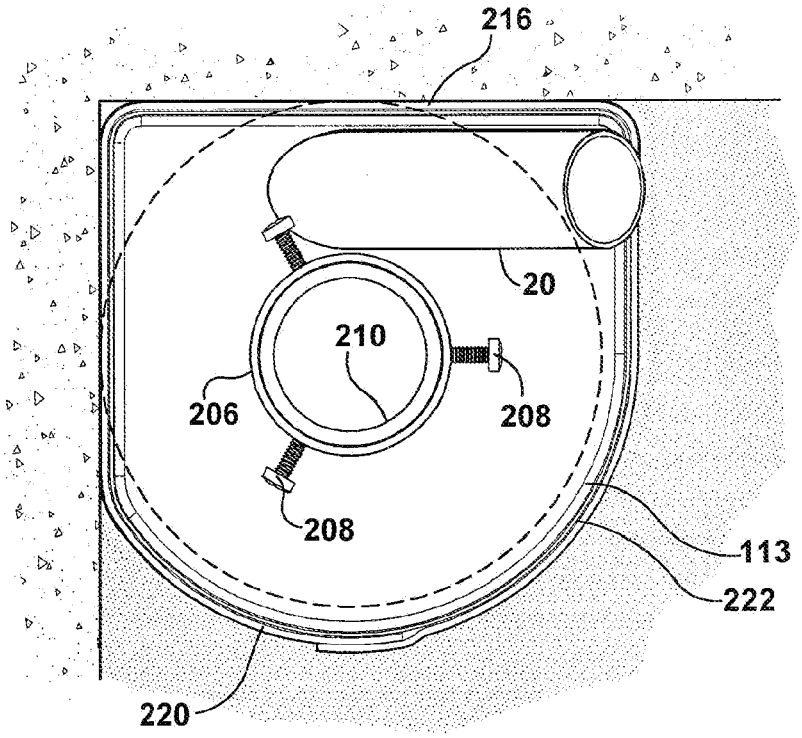
FIG. 35 is a plan view of the shroud of FIG. 34 showing the grinding of a floor at a wall corner intersection.

FIGS. 34 and 35 illustrate a further embodiment of an abrading too dust shroud which allows grinding into corners. This embodiment has two flattened segments 111*a* and 111*b* at right angles to one another with a pair of respective cut-outs 223 in the seal band 220. Grinding disc 216 will protrude out both cut-outs 223 to allow fairly close grinding into corners. FIG. 35 shows the shroud with cutting disc working into a corner. This will reduce the manual finishing required to completely grind into the corner. Cover band 224 is shaped to fit the shroud and overlay the cut-outs 223 when corner abrading is not required. The shape of the shroud can be adapted to suit requirements.

Figure 36:
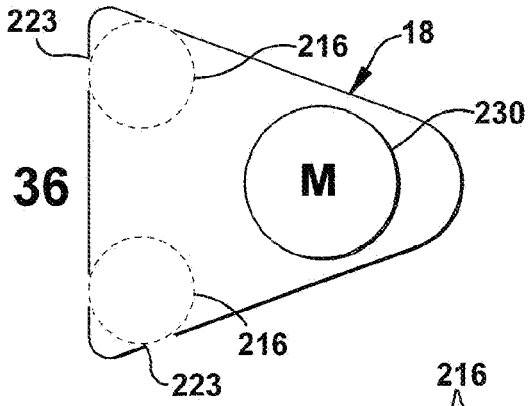
FIGS. 36 to 38 show the variations of shape and number of grinding wheels that can be incorporated into a shroud made according to the invention.
Figure 37:
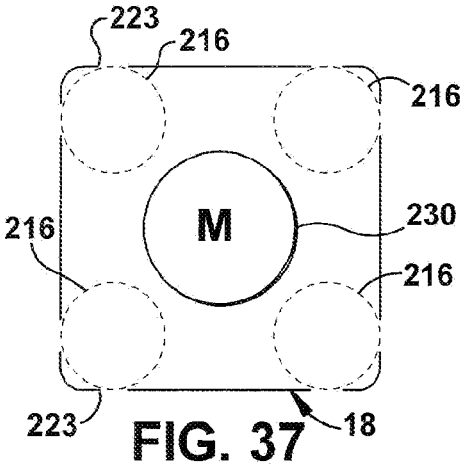
Figure 38:
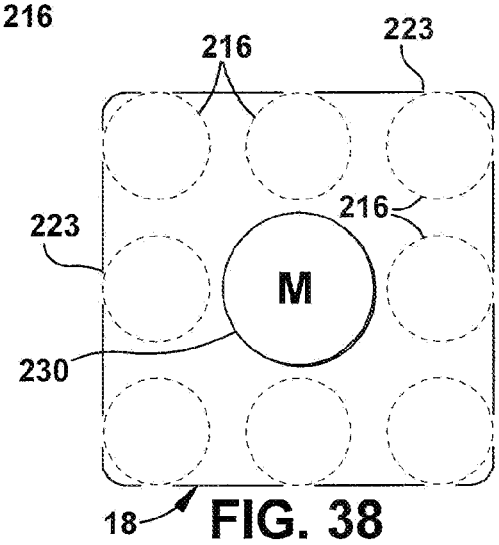

FIGS. 36 to 38 show variations of the embodiment shown in FIGS. 34 and 35. In these embodiments a motor 230 is coupled to multiple grinding discs 216 to provide greater grinding capability for the floor and corners. The number of grinding discs 216, positioning of the grinding discs 216 and the shape of shroud 18 can to adapted to suit the type of grinding to be undertaken. In each of these multiple grinding disc embodiments, one or more of the grinding discs can be located with respect to the shroud so that a periphery of the disc extends beyond the shroud, such as for example beyond a flattened segment of a depending flange of the shroud, and through a shroud band 220 attached to the depending flange of the shroud, all as previously described in connection with the other embodiments.

Although the embodiments illustrate use by a right handed operator it is evident to the man skilled in the art that the position of handle 16 could also be mirrored to the other side. The embodiments have been described with reference to their use with angle grinders but the invention is not limited to that use. The hand tool support could be readily adapted to other tools e.g. saws, scarifiers, floor polishers, sanding machines, etc.

The invention will be understood to embrace many further modifications as will be readily apparent to persons skilled in the art and which will be deemed to reside within the broad scope and ambit of the invention, there having been set forth herein only the broad nature of the invention and a certain specific embodiment by way of example.

The claims defining the invention are as follows:

1. A dust shroud for an abrading tool, the dust shroud comprising:

a base plate having a depending flange which depends from a periphery of the base plate;

an outlet pipe which extends from the base plate to provide an opening for extraction of abraded material from the dust shroud, a flattened segment on the base plate and the depending flange for exposing the abrading tool for edging work; and, a peripheral flexible skirt surrounding said depending flange including the flattened segment and said flexible skirt extending beyond the depending flange including the flattened segment of the depending flange.

2. A dust shroud according to claim 1, wherein the peripheral flexible skirt includes a cut out section or gap along a part of the flattened segment, the cut out section or gap for exposing said abrading tool for edging work.

3. A dust shroud according to claim 2, further including attachment means to hold the peripheral flexible skirt to the depending flange to allow for adjustment of the depth of the peripheral flexible skirt, said attachment means to hold said peripheral flexible skirt comprises one part of a hook and loop fastener affixed to said depending flange and the other part of said hook and loop fastener comprising said peripheral flexible skirt.

4. A dust shroud according to claim 3, further including a further hook and loop fastener which co-operates with said other part of said hook and loop fastener to further cover said flattened segment.

5. A dust shroud according to claim 2, wherein said abrading tool cuts through said peripheral flexible skirt to form said cut out section or gap when first used for said edging work.

6. A dust shroud according to claim 1, further including adjustable attachment means for attaching the peripheral depending flange to the intermediate skirt to allow for adjustment of the depth of the peripheral flexible skirt.

7. A dust shroud according to claim 6, wherein the adjustable attachment means to hold the peripheral flexible skirt is a clamp.

8. A dust shroud according to claim 7, wherein the clamp is a band clamp.

9. A dust shroud according to claim 1, wherein the depending flange is made of a non-flexible material.

10. A dust shroud according to claim 1, further including a separate arcuate segment including a base plate and co-operating depending flange part, the arcuate segment co-operating with the flattened segment when edging work is not required.

11. A dust shroud according to claim 10, wherein the co-operating depending flange part includes a flexible skirt part.

12. A dust shroud according to claim 1, further including a fixing means to attach the dust shroud to the abrading tool.

13. A dust shroud according to claim 1, wherein the dust shroud includes an annular section on said base plate for reception of a shaft bearing of said abrading tool.

14. A dust shroud according to claim 13, wherein said shroud includes an annular collar to be inserted into said annular section and over said shaft bearing to allow for variation in shaft bearing diameter of said abrading tool.

15. The dust shroud according to claim 14 wherein the annular collar to be inserted into said annular section and over said shaft bearing further comprises an eccentricity in an interior opening which fits over the shaft bearing.

16. A dust shroud according to claim 1, further including a further flattened segment for exposing the abrading tool for additional edging work.

17. A dust shroud according to claim 16, wherein said further flattened segment is at right angles to said flattened segment.

18. A dust shroud according to claim 1, further including a plurality of further flattened segments for exposing the abrading tool and/or a plurality of abrading tools for additional edging work.

19. A dust shroud according to claim 1, wherein the abrading tool is a grinding disc attached to a grinder.

20. A dust shroud according to claim 19, wherein said grinder is attached at one end to a support plate having a wheel or wheels or castor or castors fitted to said support plate at the other end of said support plate.

21. A dust shroud according to claim 20, wherein said wheels or castors allow height adjustment relative to said support plate to provide a level orientation of said grinding disc on a floor to be abraded.

22. The dust shroud of claim 1 wherein an annular section extends from the base plate and is configured to fit about an annular bearing of the abrading tool through which the shaft of a motor extends, and a collar which fits between the annular section of the dust shroud and the annular bearing.

23. The dust shroud of claim 22 wherein the annular section of the dust shroud is secured to the annular bearing of the abrading tool by one or more fasteners which extend through the annular section and which contact the collar.

24. The dust shroud of claim 22 comprising one or more collars, each of the one or more collars having a common outer diameter and a different inner diameter from the inner diameters of the other collars.

25. The dust shroud of claim 22 wherein the collar is generally cylindrical and has an internal opening for receiving the annular bearing which is eccentric with respect to the cylindrical sides of the collar.

26. A dust shroud for an abrading tool, the dust shroud comprising:

a base plate having a depending flange;

an outlet opening for extraction of abraded material, a flattened segment in the depending flange beyond which an edge of a grinding disc of the abrading tool extends; and a peripheral flexible skirt surrounding said depending flange and attached to and depending from the depending flange wherein the peripheral flexible skirt includes an opening in the flattened segment formed by the edge of the grinding disc of the abrading tool, and further including adjustable attachment means for attaching the peripheral flexible skirt to an intermediate skirt attached to the depending flange to allow for adjustment of a position of the peripheral flexible skirt with respect to the depending flange.

27. A dust shroud according to claim 26, wherein the peripheral flexible skirt is made of a flexible material.

28. A dust shroud according to claim 26, wherein the dust shroud and the depending flange of the dust shroud are made of a non-flexible material.

29. A dust shroud according to claim 26, wherein the adjustable attachment means to hold the peripheral flexible skirt to the intermediate skirt to allow for adjustment of the depth of the peripheral flexible skirt comprises a first part of a hook and loop fastener affixed to said intermediate skirt and a second part of said hook and loop fastener comprising said peripheral flexible skirt.

30. A dust shroud according to claim 26, further including a further hook and loop fastener which co-operates with said other part of said hook and loop fastener to cover the opening in the peripheral flexible skirt.

31. A dust shroud according to claim 26, wherein the dust shroud includes an annular section on said base plate for reception of a shaft bearing from said abrading tool.

32. A dust shroud according to claim 26, wherein said shroud includes at least one annular collar to be inserted into said annular section and over said shaft bearing to allow for variation in shaft bearing diameter from said abrading tool.

33. A dust shroud according to claim 26, further including an additional flattened segment for exposing the abrading tool for additional edging work.

34. A dust shroud according to claim 33, wherein said additional flattened segment is at a right angle to said flattened segment.

35. A dust shroud according to claim 26, further including a plurality of additional flattened segments for exposing the abrading tool and/or a plurality of abrading tools for additional edging work.

36. A dust shroud according to claim 26, wherein the abrading tool is a grinding disc attached to a grinder.

37. A dust shroud according to claim 26, wherein said grinder is attached at one end to a support plate and a pair of wheels or castors are fitted to said support plate at the other end of said support plate.

38. A dust shroud according to claim 37, wherein said wheels or castors allow height adjustment relative to said support plate to provide a level orientation of said grinding disc on a floor to be abraded.

39. A dust shroud according to claim 26, wherein said grinding disc cuts through said peripheral flexible skirt to form said opening when first used for said edging work.

40. In combination, an abrading tool having a motor in a casing and a grinding disc attached to a shaft of the motor, and a dust shroud attached to the casing and about the shaft of the motor and extending over the grinding disc, the dust shroud having a base plate which extends over the grinding disc and a depending flange which depends from the base plate, the depending flange having at least one flattened segment and wherein a periphery of the grinding disc extends to a periphery of the flattened segment of the depending flange, and a peripheral flexible skirt surrounding and attached to the depending flange and depending downward from a lower edge of the depending flange so that the edge of the grinding disc contacts the peripheral flexible skirt.

41. The combination of claim 40 further comprising an opening in the peripheral flexible skirt which is formed by the periphery of the grinding disc.

42. The combination of claim 40 further comprising a cover band attached to the peripheral flexible skirt and positioned over the opening in the peripheral flexible skirt.

43. The combination according to claim 41, wherein said grinding disc cuts through said peripheral flexible skirt to form said opening when first used for edging work.

* * * * *